US010293361B2

(12) United States Patent
Mizoguchi et al.

(10) Patent No.: US 10,293,361 B2
(45) Date of Patent: May 21, 2019

(54) CARTRIDGE FOR VISCOUS-MATERIAL DISPENSER

(71) Applicant: KAGA WORKS CO., LTD., Nagoya-shi (JP)

(72) Inventors: Osamu Mizoguchi, Nagoya (JP); Hitoshi Tsujikawa, Nagoya (JP); Kyota Imai, Nagoya (JP); Akira Kanazawa, Kasugai (JP)

(73) Assignee: KAGA WORKS CO., LTD., Nagoya-Shi (JP)

( * ) Notice: Subject to any disclaimer, the term of this patent is extended or adjusted under 35 U.S.C. 154(b) by 0 days.

(21) Appl. No.: 15/768,959

(22) PCT Filed: Oct. 17, 2016

(86) PCT No.: PCT/JP2016/080677
§ 371 (c)(1),
(2) Date: Apr. 17, 2018

(87) PCT Pub. No.: WO2017/069082
PCT Pub. Date: Apr. 27, 2017

(65) Prior Publication Data

US 2018/0297054 A1 Oct. 18, 2018

(30) Foreign Application Priority Data

Oct. 19, 2015 (JP) ..... 2015-205644

(51) Int. Cl.
*B05C 5/00* (2006.01)
*B05C 5/02* (2006.01)
(Continued)

(52) U.S. Cl.
CPC ..... *B05C 17/0052* (2013.01); *B05C 5/00* (2013.01); *B05C 17/00596* (2013.01);
(Continued)

(58) Field of Classification Search
CPC ..... B05C 17/0052; B05C 17/00596; B05C 17/015; B05C 5/02; B65D 83/0005; B65D 83/207
(Continued)

(56) References Cited

U.S. PATENT DOCUMENTS 3,099,370 A * 7/1963 Hein ..... B65D 83/646 222/386.5
4,704,105 A 11/1987 Adorjan et al.
(Continued)

FOREIGN PATENT DOCUMENTS

DE 3718948 A1 12/1988
EP 0900599 A2 3/1999
(Continued)

OTHER PUBLICATIONS

Supplemental European Search Report dated Jul. 19, 2017 in related EP application No. 15 836 747.4, including European Search Opinion, European Search Report and examined claims 1-16.
(Continued)

*Primary Examiner* — Benjamin R Shaw
(74) *Attorney, Agent, or Firm* — J-Tek Law PLLC; Jeffrey D. Tekanic; Scott T. Wakeman

(57) ABSTRACT

A cartridge for a viscous-material dispenser includes a cylinder and a plunger axially slidably fitted in the cylinder and dividing the cylinder into a filling chamber and a pressurizing chamber and includes a plurality of solid spacers in an annular gap between the plunger and the cylinder for maintaining a minimum spacing between the plunger and the cylinder. The spacers at least partially define a plurality of passages that fluidically connect the filling and pressurizing chambers and are configured such that a first portion of the viscous material extending from the filling chamber into the plurality of passages forms a seal together with the solid
(Continued)

spacers to prevent a second portion of the viscous material located in the filling chamber from entering the plurality of passages.

9 Claims, 15 Drawing Sheets

(51) Int. Cl.
*B65D 83/00* (2006.01)
*B65D 83/20* (2006.01)
*B05C 17/005* (2006.01)
*B05C 17/015* (2006.01)

(52) U.S. Cl.
CPC ..... *B05C 17/015* (2013.01); *B65D 83/00* (2013.01); *B65D 83/0005* (2013.01); *B65D 83/207* (2013.01); *B05C 5/02* (2013.01)

(58) Field of Classification Search
USPC ..... 222/386.5
See application file for complete search history.

(56) References Cited

U.S. PATENT DOCUMENTS

| | | | | |
|---|---|---|---|---|
| 4,840,293 | A | 6/1989 | Segatz | |
| 4,986,444 | A | 1/1991 | Corso | |
| 5,242,091 | A | 9/1993 | Ishida et al. | |
| 5,360,146 | A * | 11/1994 | Ikushima | B05C 17/00576 222/326 |
| 5,547,107 | A | 8/1996 | Boiardi | |
| 5,680,967 | A * | 10/1997 | Dang | B65D 83/0005 222/327 |
| 5,718,357 | A * | 2/1998 | Dang | B05C 17/00576 222/153.06 |
| 6,334,553 | B1 * | 1/2002 | Bouras | B05C 11/10 222/386 |
| 6,655,555 | B1 | 12/2003 | Yankoglu et al. | |
| 6,681,810 | B2 | 1/2004 | Weston | |
| 7,458,487 | B1 | 12/2008 | Ikushima | |
| 7,878,377 | B2 | 2/2011 | Ikushima | |
| 9,126,702 | B2 | 9/2015 | Mizoguchi et al. | |
| 9,340,306 | B2 | 5/2016 | Mizoguchi et al. | |
| 9,598,223 | B2 | 3/2017 | Mizoguchi et al. | |
| 2006/0043120 | A1 * | 3/2006 | Campbell | B05C 17/0146 222/386.5 |
| 2009/0026226 | A1 | 1/2009 | Ikushima | |
| 2009/0198182 | A1 | 8/2009 | Fujishima et al. | |
| 2009/0272767 | A1 | 11/2009 | Herman et al. | |
| 2010/0147896 | A1 | 6/2010 | Obrist | |
| 2011/0254187 | A1 | 10/2011 | Mizoguchi et al. | |
| 2012/0205001 | A1 | 8/2012 | Mizoguchi et al. | |
| 2014/0084022 | A1 | 3/2014 | Paul et al. | |
| 2015/0069091 | A1 | 3/2015 | Mizoguchi et al. | |
| 2015/0336690 | A1 | 11/2015 | Mizoguchi et al. | |
| 2016/0221696 | A1 | 8/2016 | Mizoguchi et al. | |
| 2017/0275079 | A1 | 9/2017 | Mizoguchi et al. | |

FOREIGN PATENT DOCUMENTS

| | | | |
|---|---|---|---|
| EP | 1270412 | B1 | 9/2005 |
| EP | 2108599 | A1 | 10/2009 |
| FR | 1228986 | A | 9/1960 |
| FR | 2259960 | A1 | 8/1975 |
| GB | 2071268 | A | 9/1981 |
| JP | S5766679 | U | 4/1982 |
| JP | S58981 | | 1/1983 |
| JP | S60500045 | | 1/1985 |
| JP | S6058281 | U | 4/1985 |
| JP | S61171565 | A | 8/1986 |
| JP | S6333202 | A | 2/1988 |
| JP | S63176576 | U | 11/1988 |
| JP | H0295571 | U | 7/1990 |
| JP | H0490868 | A | 3/1992 |
| JP | H04200672 | A | 7/1992 |
| JP | H0557870 | A | 3/1993 |
| JP | H05147677 | A | 6/1993 |
| JP | H05200343 | A | 8/1993 |
| JP | 5254580 | A | 10/1993 |
| JP | 642800 | U | 6/1994 |
| JP | H06283856 | A | 10/1994 |
| JP | H07106331 | B2 | 11/1995 |
| JP | H11104404 | A | 4/1999 |
| JP | 2000507535 | A | 6/2000 |
| JP | 3073311 | U | 11/2000 |
| JP | 2000317370 | | 11/2000 |
| JP | 2000344282 | A | 12/2000 |
| JP | 2002080005 | A | 3/2002 |
| JP | 2003054694 | A | 2/2003 |
| JP | 2004037935 | A | 2/2004 |
| JP | 2004321985 | A | 11/2004 |
| JP | 2007176536 | A | 7/2007 |
| JP | 2010042361 | A | 2/2010 |
| JP | 2010164196 | A | 7/2010 |
| JP | 4659128 | B1 | 3/2011 |
| JP | 5101743 | B1 | 12/2012 |
| JP | 2013212466 | A | 10/2013 |
| JP | 2013212878 | A | 10/2013 |
| JP | 5651803 | B1 | 1/2015 |
| WO | 9849994 | A | 11/1998 |
| WO | 2016031722 | A | 3/2016 |

OTHER PUBLICATIONS

Office Action from the United States Patent Office dated Jul. 25, 2018 in related U.S. Appl. No. 15/504,720, including examined claims 1-21.
Office Action from the United States Patent Office dated Sep. 25, 2018 in related U.S. Appl. No. 15/504,720.
English translation of the International Search Report dated Jan. 10, 2017 for parent application No. PCT/JP2016/080677.
English translation of the Written Opinion of the International Searching Authority dated Jan. 10, 2017 for parent application No. PCT/JP2016/080677.
Office Action from the Japanese Patent Office dated Nov. 20, 2018 in counterpart Japanese application No. 2018-001568, and translation thereof.
Search Report from the Japanese Patent Office dated Nov. 9, 2018 in counterpart Japanese application No. 2018-001568, and machine translation thereof.

* cited by examiner

| | | |
|---|---|---|
| S1 | PREPARE VISCOUS MATERIAL | |
| | S11 | MIX |
| | S12 | AGITATE AND DEGAS |
| S2 | FILL WITH VISCOUS MATERIAL | |
| | S21 | PREPARE CONTAINER SET |
| | S22 | HOLD CONTAINER SET |
| | S23 | PREPARE CARTRIDGE |
| | S24 | HOLD CARTRIDGE |
| | S25 | INSERT ROD |
| | S26 | EXTRUDE |
| | S27 | ASSIST UPWARD DISPLACEMENT OF ROD |
| | S28 | RETRACT ROD |
| | S29 | REMOVE CARTRIDGE |
| | S30 | REMOVE CONTAINER SET |

FIG.11

CARTRIDGE FOR VISCOUS-MATERIAL DISPENSER

CROSS-REFERENCE

This application is the US national stage of International Patent Application No. PCT/JP2016/080677 filed on Oct. 17, 2016, which claims priority to Japanese Patent Application No. 2015-205644 filed on Oct. 19, 2015.

TECHNICAL FIELD

The invention relates to dispensing syringes for dispensing viscous materials and to methods of dispensing viscous materials, and more particularly to, for example, cartridges for use in dispensers that discharge viscous materials.

BACKGROUND ART

Fields are already known that deal with viscous materials. Such applications include sealants for mechanical or electrical components, encapsulants, coating agents, grease, resin compositions (e.g., epoxy resins), adhesives, pastes for use in forming electrical or electronic circuits, solders for use in mounting electronic components, etc. Such viscous materials are used in, for example, the aerospace industry, the electrical industry, the electronics industry, etc.

In order to apply a viscous material to a desired target, dispensers are used that discharge a viscous material. An example thereof is a mechanical dispenser that dispenses a viscous material by pressing a plunger using a mechanical force; another example is a pneumatic dispenser that dispenses a viscous material by pressing a plunger using pressurized gas; yet another example is an electronic dispenser that dispenses a viscous material by pressing a plunger using an electric motor.

Hereinbelow, although drawbacks of known cartridges for viscous-material dispensers will be described in detail by using a pneumatic dispenser as an example, persons skilled in the art can easily imagine the same drawbacks existing in other types of dispensers, such as for example, in the mechanical dispenser and the electronic dispenser mentioned above; in addition, persons skilled in the art can easily imagine the same drawbacks existing in still other types of dispensers, such as for example, a dispensing syringe.

Generally speaking, a cartridge is configured to be exchangeably loaded into a pneumatic dispenser, which is assembled by fitting a plunger or a piston in a cylinder. As a result of the fitting, an inner chamber of the cylinder is divided into a filling chamber, into which the viscous material is filled from outside of the filling chamber (i.e., an example of an "anterior chamber" described later), and a pressurizing chamber (i.e., an example of a "posterior chamber" described later) into which the pressurized gas is introduced from outside of the pressurizing chamber.

In order to discharge the viscous material towards a desired target using a pneumatic dispenser of this type, it is first necessary to fill the filling chamber in the cylinder of the pneumatic dispenser with the viscous material. Following the filling, the viscous material is discharged towards the desired target by applying pressure to the plunger in the pneumatic dispenser using the pressurized gas in the pressurizing chamber.

The co-inventors repeatedly performed experiments in which a viscous material is filled into a conventional cartridge assembled by fitting a conventional plunger in a cylinder, and after completion of the filling, the cartridge is attached to a pneumatic dispenser and the viscous material is discharged from the pneumatic dispenser.

As a result, the co-inventors obtained the following insights. That is, in the filling stage, it is important to simultaneously fulfill: the need (intended air venting or degassing of the viscous material) to vent air, which is present in a filling chamber, by passing it through a clearance between the plunger and the cylinder, and the need (viscous material leakage prevention) to create, after completion of the air venting, a seal between the plunger and the cylinder, to thereby prevent the viscous material from leaking from the filling chamber into the pressurizing chamber.

In addition, in the discharging stage, it is important to create a seal between the plunger and the cylinder, to thereby prevent the ingress of the pressurized gas from the pressurizing chamber into the filling chamber (pressurized air leakage prevention). An unintended leakage of the pressurized gas from the pressurizing chamber into the filling chamber could cause a problem that the pneumatic dispenser fails to expel the viscous material properly, and a problem that the pressurized gas unintentionally enters the filling chamber, in which the viscous material is stored as a material to be expelled next, and gas bubbles are entrapped in the viscous material within the filling chamber.

To achieve the demands described above, the co-inventors developed a new plunger. This plunger is disclosed in Patent Document No. 1.

More specifically, at least two lands are formed on an outer circumferential surface of this plunger such that each land extends circumferentially. These lands include a first land proximal to the filling chamber, and a second land proximal to the pressurizing chamber. Since the second land is larger in diameter than the first land, a radial clearance created between the top surface of the second land and an inner circumferential surface of a cylinder is smaller than that created between the top surface of the first land and the inner circumferential surface of the cylinder.

This plunger is fitted within the cylinder to provide a cartridge for a pneumatic dispenser; when the cartridge undergoes the filling stage, initially, air within the filling chamber is vented to the pressurizing chamber through clearances between the first land and the cylinder and between the second land and the cylinder.

Upon completion of the air venting (i.e., degassing of the viscous material), a portion of the viscous material within the filling chamber passes through a radial clearance between the plunger and the cylinder upstream of the first land, and reaches the first land, thereby completing the creation of a first seal between the first land and the cylinder. In other words, a portion of the viscous material that is to be used for the filling forms the first seal.

With time, another portion of the viscous material reaches the second land, thereby creating a second seal between the second land and the cylinder. In other words, another portion of the viscous material that is to be used for the filling forms the second seal. In the filling stage, after the first and second seals are completed, the viscous material is prevented from leaking from the filling chamber to the pressurizing chamber.

In the ensuing discharging stage, from its beginning, both the first and second seals are completed. As a result, pressurized gas, once introduced into the pressurizing chamber, is blocked by the second seal. This prevents the pressurized gas from leaking from the pressurizing chamber into the filling chamber.

PATENT DOCUMENT

Patent Document No. 1: Japanese Patent No. 5101743

SUMMARY OF THE INVENTION

The co-inventors repeatedly performed experiments using that plunger, and as a result, the co-inventors obtained the following insights.

That is, in the discharging stage of this plunger, pressurized gas from the outside is introduced into the pressurizing chamber located behind the plunger. As a result, the rear pressure on the plunger rapidly increases relative to the pressure of the filling chamber, and a thrust force on the plunger arises. Owing to this thrust force, the plunger advances towards the filling chamber, and as a result, the viscous material is discharged from the filling chamber to the outside.

Ideally, it is important to apply the pressurized gas to the plunger so that the rear pressure is generated and applied to the plunger without producing any moment, i.e., a tilting moment, in a direction that causes the plunger to tilt relative to the cylinder.

The reason is that, if such a tilting moment occurs, the plunger tilts relative to the cylinder, resulting in a tendency in which, in one region of the plunger, the plunger moves radially outwardly and strongly pushes against the inner circumferential surface of the cylinder, while, in another region of the plunger, the plunger moves radially inwardly and separates from the inner circumferential surface of the cylinder.

When the plunger locally separates from the inner circumferential surface of the cylinder, the radial clearance between the plunger and the cylinder locally enlarges, and gaps are locally generated in the viscous material that fills this enlarged portion. When the pressurized gas from the pressurizing chamber enters into these gaps, the gaps are stretched longitudinally and, in the worst case, this induces unexpected passages, which cause the pressurizing chamber to communicate with the filling chamber, to form. These passages cause the pressurized gas to be unintentionally introduced into the viscous material that has filled into the filling chamber and that is about to be discharged, and as a result, gas bubbles are entrapped in the viscous material.

However, practically, it is impossible to operate the plunger such that the rear pressure acts on the plunger while absolutely no such tilting moment occurs on the plunger.

Based upon the above-described insights, the invention has been created for the purpose of providing a cartridge that is exchangeably loaded into any type of viscous-material dispenser that discharges a viscous material, in which the tendency of the plunger to unintentionally tilt relative to the cylinder is eliminated or reduced in the discharging stage of the viscous material from the cartridge, thereby eliminating or reducing the possibility that unintended tilting causes gas bubbles to be entrapped in the viscous material within the filling chamber.

According to the present invention, the following modes are provided. These modes will be stated below such that these modes are divided into sections and are numbered, and such that these modes depend upon other mode(s), where appropriate. This facilitates a better understanding of some of the plurality of technical features and the plurality of combinations thereof disclosed in this specification, and does not mean that the scope of these features and combinations should be interpreted to limit the scope of the following modes of the invention. That is to say, it should be interpreted that it is allowable to select the technical features, which are stated in this specification but which are not stated in the following modes, as technical features of the invention.

Furthermore, reciting herein each one of the selected modes of the invention in a dependent form so as to depend from the other mode(s) does not exclude the possibility of the technical features in the dependent-form mode from becoming independent of those in the corresponding dependent mode(s) and to be removed therefrom. It should be interpreted that the technical features in the dependent-form mode(s) may become independent according to the nature of the corresponding technical features, where appropriate.

Mode (1): A cartridge for a viscous-material dispenser that discharges a viscous material, comprising:

a cylinder;

a plunger axially slidably fitted within the cylinder;

an anterior chamber in front of the plunger and a posterior chamber behind the plunger created in a fitted state when the plunger is fitted within the cylinder, the anterior chamber serving as a filling chamber into which the viscous material is filled from the outside; and a seal located between an inner circumferential surface of the cylinder and an outer circumferential surface of the plunger, wherein the seal includes:

at least one spacer in the form of at least one solid element disposed such that the at least one solid element fills an annular gap between the outer circumferential surface of the plunger and the inner circumferential surface of the cylinder not entirely circumferentially in at least one of cross sections of the cartridge, the at least one spacer preventing the outer circumferential surface of the plunger and the inner circumferential surface of the cylinder from radially approaching each other beyond an approach limit during operation of the cartridge; and an axially-continuous clearance formed within the annular gap in a region in which the at least one spacer is not located, extending within the cartridge in a direction at least including an axial directional component and allowing the anterior chamber and the posterior chamber to be in fluid communication with each other, and when the viscous material is filled into the filling chamber from the outside, the axially-continuous clearance is filled with the viscous material, and the filled axially-continuous clearance and the at least one spacer together form the seal.

Mode (2): The cartridge for viscous-material dispenser according to Mode (1), wherein the at least one spacer is integrally formed with the plunger and includes a first member that radially outwardly protrude from the outer circumferential surface of the plunger.

Mode (3): The cartridge for viscous-material dispenser according to Mode (2), wherein the first member has a top end face at which the first member is at least temporarily brought into contact with the inner circumferential surface of the cylinder to support the cylinder during operation of the cartridge.

Mode (4): The cartridge for viscous-material dispenser according to any one of Modes (1)-(3), wherein the at least one spacer is integrally formed with the cylinder and includes a second member that radially inwardly protrudes from the inner circumferential surface of the cylinder.

Mode (5): The cartridge for viscous-material dispenser according to Mode (4), wherein the second member has a top end face at which the second member is at least temporarily brought into contact with the outer circumferential surface of the plunger to support the plunger during operation of the cartridge.

Mode (6): The cartridge for viscous-material dispenser according to any one of Modes (1)-(5), wherein the at least one spacer includes a third member that is separate from both the plunger and the cylinder and that is disposed between the outer circumferential surface of the plunger and the inner circumferential surface of the cylinder.

Mode (7): The cartridge for viscous-material dispenser according to Mode (6), wherein the third member includes an exterior face at which the third member is at least temporarily brought into contact with the inner circumferential surface of the cylinder to support the cylinder and an interior face at which the third member is at least temporarily brought into contact with the outer circumferential surface of the plunger to support the plunger, during operation of the cartridge.

Mode (8): The cartridge for viscous-material dispenser according to any one of Modes (1)-(7), wherein the dispenser is a pneumatic dispenser that discharges the viscous material forwards from the filling chamber by exerting pressurized gas onto the plunger from behind, and the posterior chamber serves a pressurizing chamber into which the pressurized gas is introduced from the outside.

Mode (9): The cartridge for viscous-material dispenser according to any one of Modes (1)-(8), wherein the at least one spacer and the axially-continuous clearance are interfaced via a continuous plane or curved plane substantially continuously varying in orientation in at least one of a circumferential direction and an axial direction.

Mode (10): A syringe for dispensing a viscous material, comprising:

a cylinder;

a plunger axially slidably fitted within the cylinder;

an anterior chamber in front of the plunger and a posterior chamber behind the plunger created in a fitted state when the plunger is fitted within the cylinder, the anterior chamber serving as a filling chamber into which the viscous material is filled from the outside; and a seal located between an inner circumferential surface of the cylinder and an outer circumferential surface of the plunger, wherein the seal includes:

at least one spacer in the form of at least one solid element disposed such that the at least one solid element fills an annular gap between the outer circumferential surface of the plunger and the inner circumferential surface of the cylinder not entirely circumferentially in at least one of cross sections of the cartridge, the at least one spacer preventing the outer circumferential surface of the plunger and the inner circumferential surface of the cylinder from radially approaching each other beyond an approaching limit during operation of the cartridge; and an axially-continuous clearance formed within the annular gap in a region in which the at least one spacer is not located, extending within the cartridge in a direction at least including an axial directional component and allowing the anterior chamber and the posterior chamber to be in fluid communication with each other, and when the viscous material is filled into the filling chamber from the outside, the axially-continuous clearance is filled with the viscous material, and the filled axially-continuous clearance and the at least one spacer together form the seal.

The invention further provides the following arrangements.

(1) A cartridge for a viscous-material dispenser that discharges a viscous material, comprising:

a cylinder having an inner circumferential surface extending axially;

a plunger having an outer circumferential surface extending, the plunger fitted within the cylinder coaxially with the cylinder and axially slidably;

an anterior chamber within an inner space of the cylinder in front of the plunger created in a fitted state when the plunger is fitted within the cylinder, the anterior chamber serving as a filling chamber into which the viscous material is filled from the outside;

a posterior chamber within the inner space of the cylinder behind the plunger created in the fitted state; and a seal located between an inner circumferential surface of the cylinder and an outer circumferential surface of the plunger, wherein, when the cartridge is viewed as a linear array of a plurality of cross-sectional slices, each cross-sectional slice includes an annular region defined by a corresponding one of segments of the outer circumferential surface of the plunger and a corresponding one of segments of the inner circumferential surface of the cylinder, the plurality of cross-sectional slices have a plurality of pairs of adjacent ones of the plurality of cross-sectional slices, for each cross-sectional slice pair that includes a first cross-sectional slice and a second cross-sectional slice, the annular region of the first cross-sectional slice has at least one first air gap along with at least one first solid element circumferentially adjacent the at least one first air gap, and the annular region of the second cross-sectional slice has at least one second air gap in fluid communication with the at least one first air gap, irrespective of whether or not there is at least one second solid element circumferentially adjacent the at least one second air gap, the at least one first air gap and the at least one second air gap of the plurality of cross-sectional slices together form an axially-continuous clearance extending in a direction including at least an axial component between the outer circumferential surface of the plunger and the inner circumferential surface of the cylinder, when the viscous material is filled into the filling chamber from the outside, a portion of the fill viscous-material enters the axially-continuous clearance and flows through the axially-continuous clearance towards the posterior chamber, thereby filling the axially-continuous clearance with the viscous material, the seal is formed as a result of the interaction of the axially-continuous clearance filled with the portion of the viscous material and the at least one first solid element, and the at least one second solid element, if any, and after the seal is formed, it blocks a succeeding portion of the viscous material, thereby preventing the succeeding portion of the viscous material from leaking from the filling chamber into the posterior chamber between the outer circumferential surface of the plunger and the inner circumferential surface of the cylinder.

(2) The cartridge for viscous-material dispenser according to (1), wherein, in a filling phase in which the viscous material is filled into the filling chamber from the outside, a portion of the viscous material travels from the filling chamber into the axially-continuous clearance, thereby filling the axially-continuous clearance with said portion of the viscous material, in a fully-filled state in which the axially-continuous clearance is fully filled with the viscous-material entirely circumferentially at at least one of axial positions, the portion of the viscous material itself blocks the succeeding portion of the viscous material thereby preventing the succeeding portion from leaking from the filling chamber into the posterior chamber, and in a pre-fully-filled state prior to the fully-filled state, unwanted gasses unwantedly existing in the filling chamber are allowed to vent, via a portion of the axially-continuous clearance that has not yet been filled with the viscous material that was filled, into the posterior chamber (3) The cartridge for viscous-material dispenser according to (1) or (2), wherein the thickness dimensions of the axially-continuous clearance are set to vary between a lower limit, which is necessary to allow the plunger to be fitted into the cylinder in an axially slidable manner without substantial play, and an upper limit, which is necessary, in a substantially final stage of a discharging phase in which the viscous material is discharged from the filling chamber to the outside, to allow the axially-continuous clearance to be substantially entirely filled with the viscous material in the axial direction of the axially-continuous clearance.

(4) The cartridge for viscous-material dispenser according to any one of (1)-(3), wherein the first solid element or the second solid element is integrally formed with the plunger and includes a first member that radially outwardly protrudes from the outer circumferential surface of the plunger.

(5) The cartridge for viscous-material dispenser according to (4), wherein the first member has a top end face, at which the first member is at least temporarily brought into contact with the inner circumferential surface of the cylinder to support the cylinder during operation of the cartridge.

(6) The cartridge for viscous-material dispenser according to any one of (1)-(5), wherein the first solid element or the second solid element is integrally formed with the cylinder and includes a second member that radially inwardly protrudes from the inner circumferential surface of the cylinder.

(7) The cartridge for viscous-material dispenser according to (6), wherein the second member has a top end face, at which the second member is at least temporarily brought into contact with the outer circumferential surface of the plunger to support the plunger during operation of the cartridge.

(8) The cartridge for viscous-material dispenser according to any one of (1)-(7), wherein the first solid element or the second solid element includes a third member that is separate from both the plunger and the cylinder and that is disposed between the outer circumferential surface of the plunger and the inner circumferential surface of the cylinder.

(9) The cartridge for viscous-material dispenser according to (8), wherein the third member includes an exterior face, at which the third member is at least temporarily brought into contact with the inner circumferential surface of the cylinder to support the cylinder, and an interior face, at which the third member is at least temporarily brought into contact with the outer circumferential surface of the plunger to support the plunger, during operation of the cartridge.

(10) The cartridge for viscous-material dispenser according to any one of (1)-(9), wherein the first solid element and the second solid element disposed in each cross-sectional slice pair are arranged spatially continuously, thereby forming at least one linear continuum extending generally in a rectilinear or spiral fashion along a longitudinal axis of the cartridge.

(11) The cartridge for viscous-material dispenser according to any one of (1)-(9), wherein the plurality of cross-sectional slices are configured such that each cross-section slice does not include the second solid element, or each cross-section slice includes the second solid element but the second solid element is not spatially continuous with the first solid element, thereby allowing a combination of the first solid elements present in the plurality of cross-sectional slices or a combination of the first and second solid elements present spatially discretely, thereby forming a plurality of discrete elements.

(12) The cartridge for viscous-material dispenser according to any one of (1)-(11), wherein the dispenser is a pneumatic dispenser that discharges the viscous material forwards from the filling chamber by exerting pressurized gas onto the plunger from behind, and the posterior chamber serves a pressurizing chamber into which the pressurized gas is introduced from the outside.

(13) A method of applying a viscous material as a sealant onto a desired target, comprising:

filling the viscous material into the cartridge according to any one of Modes (1)-(10) or any one of (1)-(12), thereby preparing the cartridge;

loading the prepared cartridge into the dispenser; and applying the viscous material as the sealant onto the desired target by operating the dispenser.

(14) A method of manufacturing an aircraft having components that are required to be in air-tight after being assembled, comprising:

filling the viscous material into the cartridge according to any one of Modes (1)-(10) or any one of (1)-(12), thereby preparing the cartridge;

loading the prepared cartridge into the dispenser; and applying the viscous material as a sealant into gaps between a plurality of components of the aircraft by operating the dispenser, thereby filling the gaps.

(15) A cartridge for a viscous-material dispenser that discharges a viscous material, comprising:

a cylinder;

a plunger axially slidably fitted within the cylinder; and a seal located between the cylinder and the plunger, wherein, when the cartridge is viewed as an array of a plurality of cross-sectional slices, each cross-sectional slice includes an annular region defined by an outer circumferential surface of the plunger and an inner circumferential surface of the cylinder, the annular region of one of adjacent ones of the plurality of cross-sectional slices has a first air gap and a first solid element, the annular region of the other has a second air gap in fluid communication with the first air gap, the first air gap and the second air gap together form an axially-continuous clearance between the outer circumferential surface of the plunger and the inner circumferential surface of the cylinder, and when the viscous material is filled into the cartridge from the outside, the axially-continuous clearance is filled with the viscous material, and the seal is formed as a result of the interaction of the filled axially-continuous clearance and the first solid element.

(16) A cartridge for a viscous-material dispenser that discharges a viscous material, comprising:

a cylinder;

a plunger axially slidably fitted within the cylinder;

an anterior chamber in front of the plunger and a posterior chamber behind the plunger created in a fitted state when the plunger is fitted within the cylinder, the anterior chamber serving as a filling chamber into which the viscous material is filled from the outside; and a seal located between an inner circumferential surface of the cylinder and an outer circumferential surface of the plunger, wherein the seal includes:

a plurality of spacers in the form of solid elements disposed such that the solid elements fill an annular gap between the outer circumferential surface of the plunger and the inner circumferential surface of the cylinder not entirely circumferentially in at least one of cross sections of the cartridge, the plurality of spacers preventing the outer circumferential surface of the plunger and the inner circumferential surface of the cylinder from radially approaching each other beyond an approach limit during operation of the cartridge; and a plurality of axially-continuous clearances formed within the annular gap in regions where the plurality of spacers is not disposed, each axially-continuous clearance extending in a direction at least including an axial directional component and allowing the anterior chamber and the posterior chamber to be in fluid communication with each other, and wherein the plurality of spacers is integrally formed with the outer circumferential surface of the plunger such that the plurality of spacers radially outwardly protrude from the outer circumferential surface of the plunger, or are integrally formed with the inner circumferential surface of the cylinder such that that the plurality of spacers radially inwardly protrude from the inner circumferential surface of the cylinder, when the plurality of spacers is integrally formed with the outer circumferential surface of the plunger, a top end face of each spacer contacts and supports the inner circumferential surface of the cylinder laterally, providing a snug fit between the plunger and the cylinder only at the plurality of spacers, thereby retaining the plurality of axially-continuous clearances while centering the cylinder with respect to the plunger, or when the plurality of spacers is integrally formed with the inner circumferential surface of the cylinder, a top end face of each spacer contacts and supports the outer circumferential surface of the plunger laterally, providing a snug fit between the plunger and the cylinder only at the plurality of spacers, thereby retaining the plurality of axially-continuous clearances while centering the plunger with respect to the cylinder, when the viscous material is filled into the filling chamber from the outside, the plurality of axially-continuous clearances are filled with the viscous material, and the plurality of filled axially-continuous clearances and the plurality of spacers together form the seal, and the plurality of spacers create a resistance to movement of the viscous material within the plurality of axially-continuous clearances, to an extent that allows, at a final point of a filling phase in which the viscous material is filled into the filling chamber, the plurality of axially-continuous clearances to be filled with the viscous material in at least one of cross-sectional segments of the cartridge, and the viscous material to be prevented from leaking from the plurality of axially-continuous clearances into the posterior chamber.

BRIEF DESCRIPTION OF THE DRAWINGS

FIG. 11 is a process flowchart illustrating the filling method, along with a viscous-material preparation method performed prior to the filling method.

EMBODIMENTS FOR CARRYING OUT THE INVENTION

Some of the more specific and illustrative embodiments of the invention will be described in the following in more detail with reference to the drawings.

First Embodiment of the Invention

Figure 1:
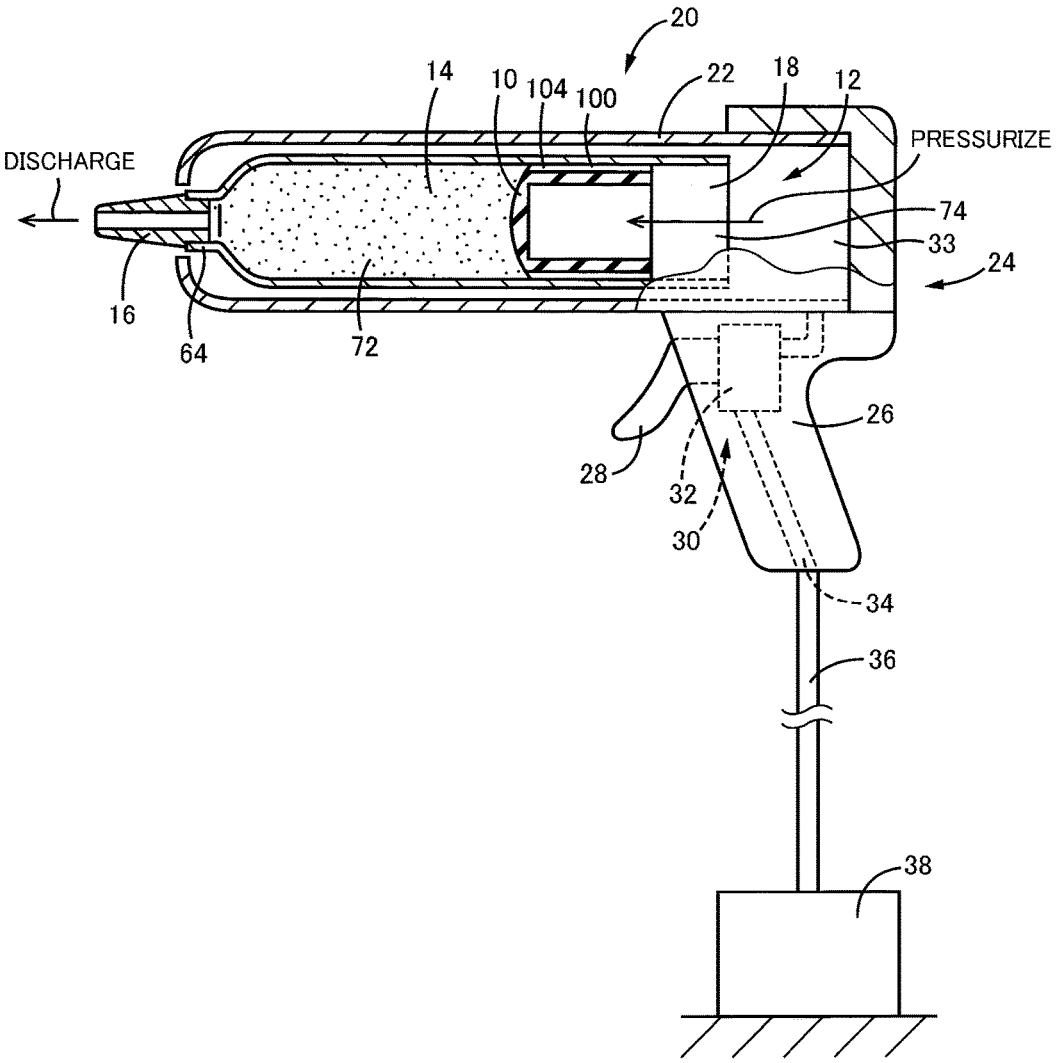
FIG. 1 is a cutaway cross-sectional side view illustrating a cartridge according to an exemplary first embodiment of the invention, in the state that the cartridge is loaded in an exemplary pneumatic dispenser.

Referring to FIG. 1, a cartridge 12 according to an exemplary first embodiment of the invention is illustrated in a cutaway cross-sectional side view, which is constructed by fitting a plunger 10 in a cylinder 18.

First, as a brief overview, prior to being loaded in a hand-held dispenser 20 (which may be the gun type depicted in FIG. 1 or a not-shown straight type), the cartridge 12 is filled with a viscous material 14 in advance (as a result of, e.g., pressurizing the viscous material 14 into the cartridge 12, or suctioning the viscous material 14 into the cartridge 12 using a negative pressure).

The dispenser 20 has a discharge nozzle 16 that is detachably attached to the distal tip end of the cylinder 18. The filled cartridge 12 is detachably or exchangeably loaded in the dispenser 20. In FIG. 1, the dispenser 20 is illustrated in an assembled state and an active state.

The cartridge 12 can be solely used, i.e., without the dispenser 20 being accompanied, and in this case, the cartridge 12 can be called dispensing syringe. That is, the cartridge 12 can be also used in an application where the cartridge 12 serves as a dispensing syringe.

An example of the viscous material 14 is a high-viscosity, electrically non-conductive sealant; an example of the application of such a sealant is seals of aircraft components. An aircraft is a machine that is required to be air-tight, and components of the aircraft are assembled so that no gaps are left between the components by filling the gaps with a sealant. The viscous material 14 can be used as the sealant.

In one specific example thereof, in modern aircraft, metal (electrically conductive) rivets are driven into through bores, which have tapered portion, within an electrically non-conductive panel, in order to join the panel, which constitutes an outer panel of the aircraft, to an inner frame.

So that the dish-shaped head of the driven rivet is not exposed, an electrically non-conductive sealant 14 is applied onto the surface of the head. At this time, the sealant 14 projects upwardly from the surface of the panel. A portion of the sealant that upwardly projects from the surface of the panel is shaved off by a worker, to shape the surface of the sealant 14; as a result, the surface of the sealant 14 conforms to the surface of the panel. Thereafter, the surface of the panel and the surface of the sealant 14 are painted with the same paint.

This exemplary sealant application method is disclosed in U.S. Pat. No. 8,617,453, the content of which is incorporated herein by reference in its entirety.

Describing first the dispenser 20, as illustrated in FIG. 1, the dispenser 20 has a cylindrical retainer 22 and a main body 24 that is detachably attached to the retainer 22. The main body 24 has a handle 26, which can be griped by an operator, and a trigger 28 (an example of a manipulation element in the form of any of a lever, a switch, a button, or the like) that is attached so as to be movable relative to the handle 26.

The main body 24 further has an air-pressure control unit 30. The air-pressure control unit 30 has a valve 32 operated by the trigger 28; the valve 32 selectively and fluidly connects a chamber 33 located behind the plunger 10 with a hose connection port 34. A high-pressure source 38 that supplies pressurized gas is coupled to the hose connection port 34 via a flexible hose 36.

When the trigger 28 is pulled by the operator, the valve 32 shifts from a closed position to an open position, thereby allowing the pressurized gas to enter the chamber (pressurizing chamber) 33 through the valve 32. When the pressurized gas impinges against the rear of the plunger 10, the plunger 10 advances relative to the cylinder 18 (in FIG. 1, is moved leftwards), thereby discharging the viscous material 14 from the cylinder 18. An example of the viscous material 14 is a high-viscosity, electrically non-conductive sealant; an example of the application of such a sealant is seals of aircraft components.

Figure 2:
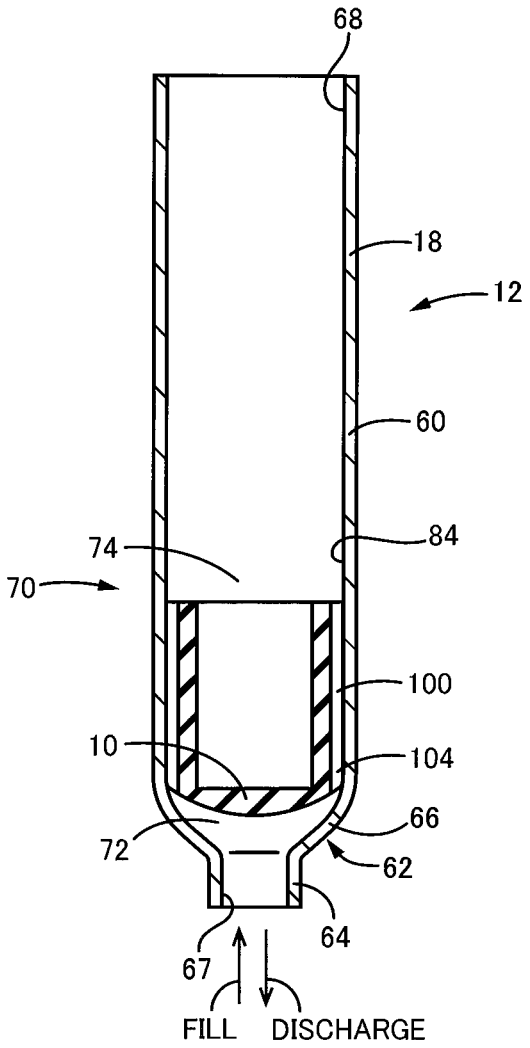
FIG. 2 is a cross-sectional side view illustrating the cartridge depicted in FIG. 1.

Next, describing the cartridge 12 schematically, as illustrated in the cross-sectional side view of FIG. 2, the cartridge 12 is configured by fitting the plunger 10 in the cylinder 18. As the material of the plunger 10, it is possible to select PE (polyethylene), PP (polypropylene), etc., to select a synthetic resin having a nearly equivalent elasticity as these, to select a synthetic resin having a higher elasticity than these, to select a synthetic resin having a lower elasticity than these, or to select a synthetic rubber (e.g., NBR). Materials known as synthetic rubbers are less stiff and instead are more elastic than synthetic resins such as PE, PP, etc.

Describing next the cylinder 18 in more detail, the cylinder 18 has a cylindrical inner chamber 70, within which the plunger 10 is detachably fitted in a substantially air-tight and axially slidable manner.

More specifically, the cylinder 18 has a tubular main body portion 60 extending straight in a uniform cross-section, and a hollow base portion 62 coupled to one of the two ends of the main body portion 60, in a coaxial alignment with respect to each other. At its tip end, the base portion 62 has a tubular portion 64 that is smaller in diameter than the main body portion 60, and the base portion 62 has a tapered portion 66 at the connection side with the main body portion 60. A through-hole in the tubular portion 64 forms a discharge port 67 of the cylinder 18, which is detachably attached to a discharge nozzle 16 (e.g., via a threaded connection), as illustrated in FIG. 1. The opposite end of the main body portion 60 is an opening 68. One example of the material constituting the cylinder 18 is PP (polypropylene), but it is not limited to this.

In the present embodiment, the viscous material 14 is filled from the outside (a container 112 depicted in FIG. 7) into the cartridge 12 by passing through the discharge port 67 of the cartridge 12; after completion of the filling, the viscous material 14 is discharged from the cartridge 12 to dispense the viscous material 14 for use by passing through the same passage, i.e., a passage within the discharge port 67 (the smallest-diameter passage of the cylinder 18). In other words, the flow of the viscous material 14 into and out of the cartridge 12 is carried out by passing through the discharge port 67, which is the smallest-diameter passage.

As illustrated in FIG. 2, the inner chamber 70 of the cylinder 18 is divided by the plunger 10, into a filling chamber 72 (one example of the anterior chamber) that stores the viscous material 14 and a pressurizing chamber 74 (one example of the posterior chamber) into which the pressurized gas is introduced, both of which are coaxially aligned. The filling chamber 72 is in communication with the discharge port 67, while the pressurizing chamber 74 is connected to the high-pressure source 38 via the valve 32, as illustrated in FIG. 1.

Although FIG. 2 shows only the cartridge 12, this cartridge 12 can be used on its own as a dispensing syringe for dispensing the viscous material 14. In other words, the cartridge 12 illustrated in FIG. 2 can serve also as a dispensing syringe according to some embodiments of the invention.

Figure 3A:
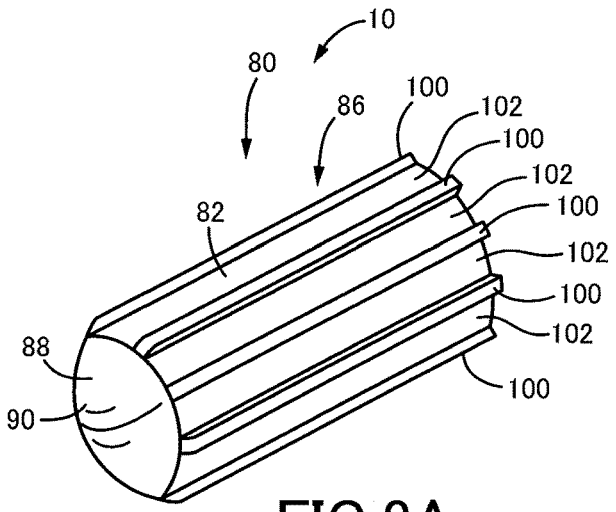
FIG. 3A is a perspective view illustrating the plunger depicted in FIG. 1.

Describing next the plunger 10 in more detail, as illustrated in FIG. 3A, the plunger 10 has a cylindrical main body portion 80 that extends axially. The main body portion 80 has a coaxial outer circumferential surface 82; in a state in which the plunger 10 is fitted in the cylinder 18 (hereinafter, referred to simply as the "fitted state"), the outer circumferential surface 82 faces an inner circumferential surface 84 of the cylinder 18 in a radial direction.

Figure 3B:
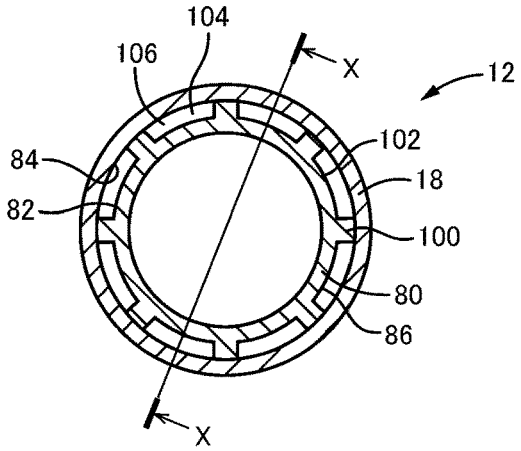
FIG. 3B is a cross-sectional view illustrating a relevant portion of the cartridge depicted in FIG. 1, and illustrating an alternating circumferential array of a spacer (or a solid element) or a ridge and an air gap or an axially-continuous clearance within an annular region defined by a base inner circumferential surface of a cylinder and a basic outer circumferential surface of a plunger.
Figure 3C:
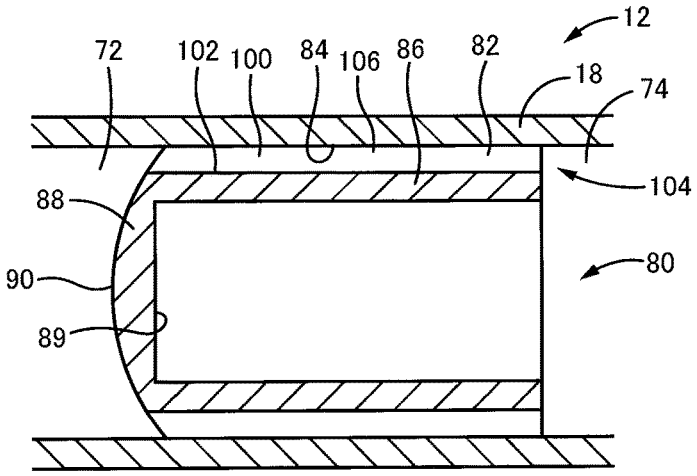
FIG. 3C is a cross-sectional view that is taken along line X-X in FIG. 3B, and that illustrates the ridge having a top end face in contact with the base inner circumferential surface of the cylinder.

In one example, the main body portion 80, as illustrated in FIGS. 3B and 3C, has a hollow circumferential wall 86, which axially extends in a uniform cross-section, and a bottom 88 that closes one end of the circumferential wall 86. In another example, the main body portion 80, although not shown, has a completely or partially solid portion that axially extends in a uniform cross-section, and a bottom that is formed at one end of the solid portion.

In one example, an exterior surface 90 of the bottom 88, as illustrated in FIGS. 3A and 3C, is shaped as a curved surface (e.g., a hemispherical surface) that is convex outwardly but devoid of any vertices. In another example, the exterior surface 90 of the bottom 88, although not shown, is shaped as a conical surface that is convex outwardly and has a vertex.

As illustrated in FIGS. 3A through 3C, on the plunger 10, on the outer circumferential surface 82 of the main body portion 80, multiple generally-axially-extending ridges 100 (an example of the solid elements integrally formed with the plunger 10) are arranged in circumferentially alternating relationship with multiple generally-axially-extending grooves 102 (an example of the air gaps that define the axially-continuous clearances). Due to this, a seal 104 that seals gaps between the outer circumferential surface 82 of the plunger 10 and the inner circumferential surface 84 of the cylinder 18 is configured.

In the present embodiment, the solid elements function as spacers defining an approach limit between the plunger 10 and the cylinder 18 when they are radially nearing each other (i.e., radial-distance defining members or centering members of the plunger 10).

The cartridge 12 can be viewed as an axial linear array of cross-sectional slices. These cross-sectional slices are obtained by, for example, conceptually slicing the cartridge 12 at any given number of axial positions. As illustrated in FIG. 3B, any one of the cross-sectional slices has an annular region defined by a corresponding one of segments of the outer circumferential surface 82 of the plunger 10 and a corresponding one of segments of the inner circumferential surface 84 of the cylinder 18. In the example depicted in FIG. 3, all the cross-sectional slices are equal in shape, and each corresponding annular region has a circumferentially alternating array of the plurality of ridges 100 (solid elements or spacers) and the plurality of grooves 102 (air gaps).

The plurality of cross-sectional slices have a plurality of pairs of adjacent ones of the plurality of cross-sectional slices. For each cross-sectional slice pair that includes a first cross-sectional slice and a second cross-sectional slice, the annular region of the first cross-sectional slice has a plurality of first air gaps (grooves 102) along with a plurality of first solid elements (ridges 100) circumferentially adjacent the first air gaps, and the annular region of the second cross-sectional slice has a plurality of second air gaps (grooves 102) in fluid communication with the plurality of first air gaps, along with a plurality of second solid elements (ridges 100) circumferentially adjacent the second air gaps.

It is noted that, although the plurality of first air gaps and the plurality of second air gaps completely coincide in phase with each other in the example depicted in FIG. 3, it is not essential that these air gaps have exactly the same phase with each other as long as these air gaps are in fluid communication with each other.

It is further noted that the plurality of first air gaps and the plurality of second air gaps completely coincide in phase with each other in the example depicted in FIG. 3, but the plurality of second solid elements can be omitted; in this case, although the plurality of first solid elements are axially adjacent to some of the plurality of second air gaps, the object of the invention can still be achieved as long as the plurality of first air gaps and the plurality of second air gaps are in fluid communication with each other in an axial direction.

In the example depicted in FIG. 3, a plurality of axially-continuous clearances 106 that extend in a direction, which has at least an axial component (in the example depicted in FIG. 3, the direction only includes the axial component), between the outer circumferential surface 82 of the plunger 10 and the inner circumferential surface 84 of the cylinder 18 is formed by interaction of the plurality of first air gaps and the plurality of second air gaps in the plurality of cross-sectional slices, with the number of the axially-continuous clearances 106 being equal to that of the grooves 102. Each axially-continuous clearance 106 can function as a passageway to provide fluid communication between the filling chamber 72 and the pressurizing chamber 74.

In the present embodiment, the ridges 100 serve as the spacers, and the spacers have not only an inherent function, that is, the function of defining an approach limit between the plunger 10 and the cylinder 18 when they are radially nearing each other, but also the function of defining the circumferential positions of the axial-continuous clearances 106.

As shown in FIG. 3C, when the viscous material 14 is being filled into the filling chamber 72 from the outside, a portion of the viscous-material 14 that has filled enters the axially-continuous clearances 106 and then flows therethrough towards the pressurizing chamber 74, thereby filling the axially-continuous clearances 106 with the viscous material 14. In the stage in which the viscous material 14 is not yet fully filled in, each axially-continuous clearance 106 serves as a passageway to allow the filling chamber 72 and the pressurizing chamber 74 to communicate with each other.

The seal 104 is formed as a result of the interaction of the axially-continuous clearances 106 that have been filled with a portion of the viscous material 14, the plurality of first solid elements (the plurality of ridges 100), and the plurality of second solid elements (the plurality of ridges 100).

In a hypothetical case where the cartridge 12 is used with a common liquid such as water, because such liquid itself does not have viscosity, it enters the axially-continuous clearances 106 and flows therethrough towards the pressurizing chamber 74; therefore, even if the liquid temporarily fills the axially-continuous clearances 106, the liquid is not retained within the axially-continuous clearances 106. In other words, the liquid does not have self-retention properties.

However, because the viscous material 14 has a viscosity higher than such a liquid, the viscous material 14 is retained within the axially-continuous clearances 106 after the viscous material 14 fills the axially-continuous clearances 106. Due to this, the seal 104 is suitably formed. In other words, the seal 104 is suitably created by using the self-retention properties of the viscous material 14.

Describing the functions of the seal 104, after it is formed, the seal 104 blocks a succeeding portion of the viscous material 14 (e.g., a newly filled portion of the viscous material 14 into the filling chamber 72), thereby preventing the succeeding portion of the viscous material 14 from leaking from the filling chamber 72 into the pressurizing chamber 74 between the outer circumferential surface 82 of the plunger 10 and the inner circumferential surface 84 of the cylinder 18.

As illustrated in FIG. 3B, tip ends of the multiple ridges 100, in the fitted state, touch the inner circumferential surface 84 of the cylinder 18, locally and at least temporarily (e.g., substantially constantly) during operation of the cartridge 12 (while being filled and while discharging) or during operation of the dispenser 20 (while discharging), thereby supporting the cylinder 18. As a result, the attitude of the plunger 10 within the cylinder 18 is stabilized during operation of the dispenser 20.

The fit between the plunger 10 and the cylinder 18, that is, the radial-contact state, in which the parts of the plunger 10 that are in contact with the cylinder 18 and the parts of the cylinder 18 that are in contact with the plunger 10 are radially in contact with each other, is expressed as a snug fit (e.g., a slide fit, a stationary fit, an interference fit, a fit with substantially zero interference). This snug fit creates a clearance smaller than a loose fit (e.g., a clearance fit).

Figure 4:
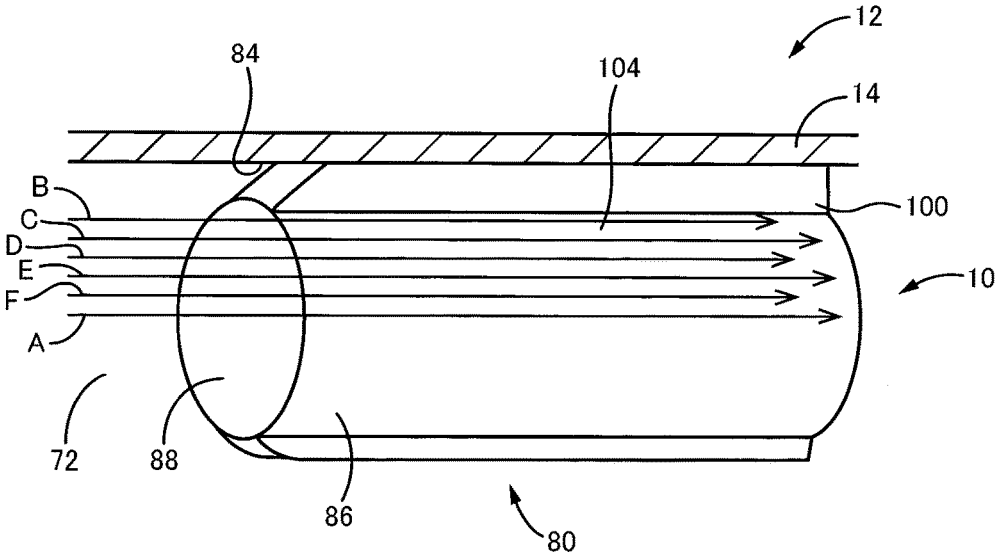
FIG. 4 is a perspective view that conceptually shows how a viscous material travels within the cartridge depicted in FIG. 1, while the viscous material is being filled into a filling chamber (i.e., an anterior chamber located forward (in the drawing, leftward) of the plunger) from the outside, from the filling chamber into axially-continuous clearances between the plunger and the cylinder, and eventually the axially-continuous clearances are filled with the viscous material, thereby forming a seal.

As illustrated in FIG. 4, when the viscous material 14 is being filled into the filling chamber 72 from the outside, the axially-continuous clearances 106 are filled sequentially from an upstream side (in the figure, the region leftward of the plunger 10) to a downstream side (in the figure, the region rightward of the plunger 10) with a portion of the viscous material 14. At this time, said portion of the viscous material 14 flows, within each groove 102, principally axially from the upstream side to the downstream side as arrows A, B, C, D, E and F show.

In this state, radial gaps can exist between top end faces of the ridges 100 and the inner circumferential surface 84 of the cylinder 18 at least temporarily (e.g., substantially constantly). When these radial gaps are present, a portion of the viscous material 14 moves circumferentially and fills the radial gaps. This allows self-sealing sections to be created by the filling of the viscous material 14 between the top end faces of the ridges 100 and the inner circumferential surface 84 of the cylinder 18.

As understood from the foregoing, in the filling phase, a portion of the viscous material 14 flows within the axially-continuous clearances 106 at least axially, thereby filling the entire axially-continuous clearances 106 with the portion of the viscous material 14. As a result, the portion of the viscous material 14 supplied from the filling chamber 72, which fills the axially-continuous clearances 106, blocks another portion of the viscous material 14 from leaking from the filling chamber 72 into the pressurizing chamber 74. In other words, a portion of the viscous material 14 is used to form the seal 104; more specifically, a portion of the viscous material 14 is used to form the seal 104 in order to seal the rest of the viscous material 14.

A plurality of factors are respectively set, including the shape of the plunger 10 (e.g., the number of the ridges 100, the shape of each ridge 100), the size of the plunger 10 (e.g., the widths and heights of the ridges 100), and the surface roughness of the plunger 10, so that, at an end time point of the filling phase, i.e., the time point at which a predetermined volume of the viscous material 14 has filled into the filling chamber 72, the axially-continuous clearances 106 are substantially completely filled, in at least one of the cross-sectional slices, entirely circumferentially (the entire area or partial area(s) of the annular region, over which the entirety of the axially-continuous clearances 106 are originally distributed), with the viscous material 14, with none of the viscous material 14 being forced out of the axially-continuous clearances 106 on the downstream side, or with a portion of the viscous material 14 being forced out of the axially-continuous clearances 106 on the downstream side, with an amount not exceeding a pre-specified amount of the viscous material 14.

To exemplify the effects of these factors, as the number of the ridges 100 increases, the resistance when the viscous material 14 moves within the axially-continuous clearances 106 increases, and its speed decreases. Likewise, as the width dimension of each ridge 100 increases (i.e., as the width dimension of each groove 102 decreases), the resistance when the viscous material 14 moves within the axially-continuous clearances 106 increases, and its speed decreases. Likewise, as the height of each ridge 100 increases, the resistance when the viscous material 14 moves within the axially-continuous clearances 106 increases, and its speed decreases.

In addition, the resistance when the viscous material 14 moves within the axially-continuous clearances 106 is higher in case the surface of the plunger 10 is an uneven surface than in case the surface of the plunger 10 is a smooth surface that does not substantially have any surface irregularities, and its speed decreases.

Describing the behavior of the viscous material 14 in more detail, in the filling phase in which the viscous material 14 is filled into the filling chamber 72 from the outside, a portion of the viscous material 14 travels from the filling chamber 72 into the axially-continuous clearances 106, thereby filling the axially-continuous clearances 106 with the portion of the viscous material 14 that serves as a fill viscous-material 14.

In the filled state, the fluidity of the fill viscous-material 14 within the axially-continuous clearances 106 in the axial direction is higher than when in the absence of the axially-continuous clearances 106, thereby facilitating the filling of the axially-continuous clearances 106 with the fill viscous-material 14 in the axial direction.

In the fully-filled state in which the axially-continuous clearances 106 are substantially fully filled with the fill viscous-material 14 in at least one of the cross-sectional slices entirely circumferentially, the fill viscous-material 14 itself blocks the rest of the viscous material 14 from leaking from the filling chamber 72 into the pressuring chamber 74.

In a pre-fully-filled state prior to the fully-filled state, unwanted gasses or gas bubbles, which unwantedly exist in the filling chamber 72, are allowed to vent or release, via a portion of the axially-continuous clearances 106 that has not yet filled with the fill viscous-material 14, into the pressurizing chamber 74.

In a discharging phase in which, in the fully-filled state, the pressurized gas is introduced into the pressurizing chamber 74 to discharge the viscous material 14 from the filling chamber 72, the fill viscous-material 14 blocks the pressurizing gas from leaking from the pressurizing chamber 74 into the filling chamber 72. This prevents the pressurized gas from being subject to unexpected leakage from the pressurizing chamber 74.

As is evident from the foregoing explanation, in the present embodiment, multiple axially-extending ridges 100 are formed on the outer circumferential surface 82 of the plunger 10, such that the ridges 100 are spaced apart from each other in the circumferential direction. In a fitted state in which the plunger 10 is fitted in the cylinder 18, multiple axially-continuous clearances 106 are formed continuously in the axial direction between the outer circumferential surface 82 of the plunger 10 and the inner circumferential surface 84 of the cylinder 18.

In the state in which the axially-continuous clearances 106 have formed, when a portion of the viscous material 14 is filled into the filling chamber 72 within the cylinder 18 from the outside, the axially-continuous clearances 106 are entirely filled with said portion of the viscous material 14. The axially-continuous clearances 106, which have been filled with said portion of the viscous material 14, interact with the multiple ridges 100, and function as the seal 104; at this time, said portion of the viscous material 14 serving as the filler forms the seal 104.

As a result, according to the present embodiment, in the filling phase of the viscous material 14, prior to completion of the seal 104, intentional venting (i.e., degassing of the viscous material 14 within the filling chamber 72) can be achieved, while, after completion of the seal 104, unintentional leakage of the viscous material 14 can be prevented; furthermore, in the discharge phase of the viscous material 14, unintentional leakage of pressurized air is prevented throughout this entire stage.

Next, more specific structures of the plunger 10 will be described in an exemplary manner.

Figure 5A:
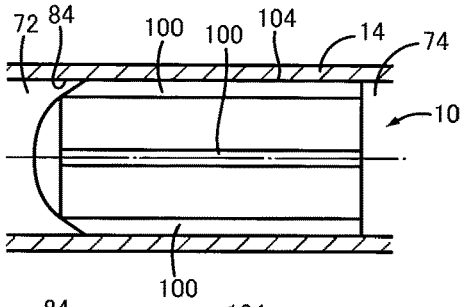
FIG. 5A is a side view illustrating one example of the cartridge depicted in FIG. 1, which has ridges having a width dimension that does not change along its axis, i.e., spacers (or solid elements) having an axially extending, constant cross-sectional profile.
Figure 5B:
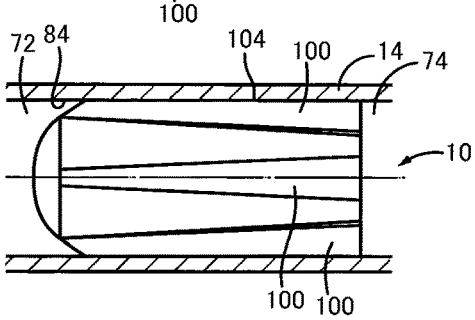
FIG. 5B is a side view illustrating another example of the cartridge depicted in FIG. 1, which has ridges having a width dimension that gradually changes along its axis, i.e., spacers (or solid elements) having an axially extending, varying cross-sectional profile.
Figure 5C:
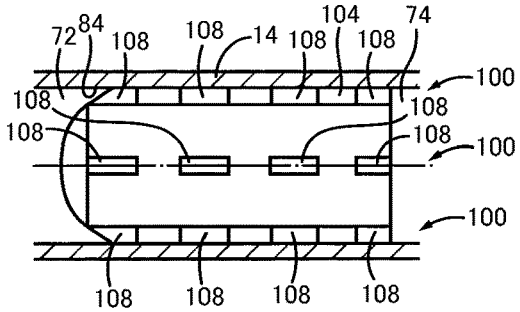
FIG. 5C is a side view illustrating still another example of the cartridge depicted in FIG. 1, which has ridges that are composed of multiple ridge segments that are discrete and aligned, i.e., ridges in the form of an alternating axial array of spacers (or solid elements) and air gaps.

As illustrated in FIGS. 3A and 3B, in the present embodiment, the plunger 10 has eight ridges 100. In alternative examples, as illustrated in FIGS. 5A, 5B and 5C, respectively, the plunger 100 has four ridges 100. In either example, the same plunger 10 has multiple ridges 100, but the objective of the invention can be achieved even when a single plunger 10 has a single ridge 100.

As illustrated in FIG. 3B, in the present embodiment, the ridges 100 are spaced apart circumferentially on the outer circumferential surface 82 in a substantially equidistant manner. In another example, although not shown, there is only a single ridge 100.

As illustrated in FIG. 3A, in the present embodiment, each ridge 100 is straight in shape and extends along one generator of the outer circumferential surface 82 of the plunger 10. In other words, each ridge 100 has only a directional component that extends in the axial direction and does not have a directional component that extends in the circumferential direction. In this example, each ridge 100 constitutes a single linear continuum.

In another example, although not shown, each ridge 100 is spiral in shape and extends transversely across a plurality of generators of the outer circumferential surface 82 of the plunger 10. In other words, each ridge 100 has not only a directional component that extends in the axial direction but also a directional component that extends in the circumferential direction.

Further, in either example, these multiple ridges 100 do not intersect on the outer circumferential surface 82 of the plunger 10. There is no intersection between the multiple ridges 100; if there were intersections, it is expected that the smooth axial flow of the viscous material 14 on the outer circumferential surface 82 of the plunger 10 would be physically impeded by such intersections.

As illustrated in FIGS. 3A and 3B, in the present embodiment, each of the ridges 100 has a smaller width dimension than each of the grooves 102.

As illustrated in FIGS. 3A and 3C, in the present embodiment, at least one of the ridges 100 extends along the substantially entire length of the plunger 10. The greater the length of each ridge 100 is, the smaller the maximum possible value of a tilt angle of the plunger 10 relative to the cylinder 18 becomes, which is effective to reduce the tilt angle of the plunger 10.

As illustrated in FIG. 5A, in the present embodiment, at least one of the ridges 100 has a constant width dimension along the length of the plunger 10.

As illustrated in FIG. 5B, in another example, at least one of the ridges 100 has a width dimension that increases in the direction from the filling chamber 72 to the pressurizing chamber 74.

In the example depicted in FIG. 5B, a circumferential gap between the ridges 100 is smaller near the pressurizing chamber 74 than near the filling chamber 72, whereby the sealing ability achieved by the seal 104 in the discharging phase is more enhanced near the pressurizing chamber 74 than near the filling chamber 72. As a result, according to this example, the risk of the pressurized gas leaking from the pressurizing chamber 74 to the filling chamber 72 in the discharging phase can be effectively curtailed.

Figure 6A:
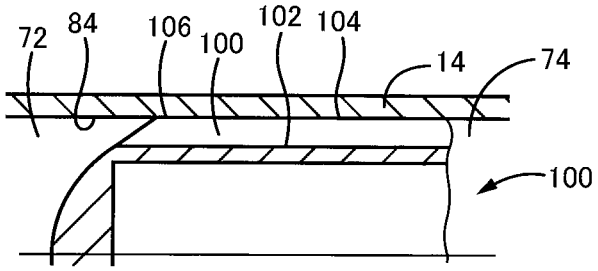
FIG. 6A is a side view illustrating one example of the cartridge depicted in FIG. 1, which has ridges having a height dimension that does not change along its axis.

As illustrated in FIG. 6A, in the present embodiment, at least one of the ridges 100 has a height dimension, from a bottom surface (having an outer diameter axially constant) of an adjacent one of the grooves 102, that does not change along the length of the plunger 10.

Figure 6B:
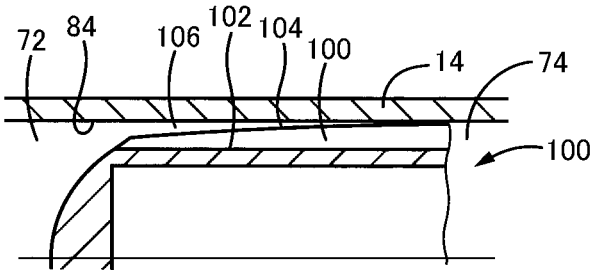
FIG. 6B is a side view illustrating another example of the cartridge depicted in FIG. 1, which has ridges having a height dimension that gradually changes along its axis.

As illustrated in FIG. 6B, in another example, at least one of the ridges 100 has a height dimension, from a bottom surface of an adjacent one of the grooves 102, that increases along the length of the plunger 10 in the direction from filling chamber 72 to the pressurizing chamber 74. The example depicted in FIG. 6B may be combined with the example depicted in FIG. 5B.

In the example depicted in FIG. 6B, the thickness of a portion of the axially-continuous clearance 106, which is minimal in thickness (i.e., the thickness of a portion of a clearance between the tip end surfaces of the ridges 100 and the inner circumferential surface 84 of the cylinder 18, which is minimal in thickness) becomes smaller at a position near the pressurizing chamber 74 than at a position near the filling chamber 72, whereby the sealing ability of the seal 104 in the discharging phase is increased at a position near the pressurizing chamber 74 more than at a position near the filling chamber 72. As a result, according to this example, the risk of the pressurized gas leaking from the pressurizing chamber 74 to the filling chamber 72 in the discharging phase can be effectively curtailed.

In one example, as illustrated in FIG. 5C, at least one of the ridges 100 is not continuous in the axial direction; multiple ridge segments 108, which are spaced apart from each other, are configured so as to be aligned in the axial direction, thereby forming each one of the ridges 100 as a plurality of discrete elements.

Also in the example depicted in FIG. 5C, the cartridge 12 has a plurality of axially aligned cross-sectional slices. Every one of these cross-sectional slices has an annular region defined by a corresponding portion of the outer circumferential surface 82 of the plunger 10 and a corresponding portion of the inner circumferential surface 84 of the cylinder 18. In the example depicted in FIG. 5C, however, unlike the example depicted in FIG. 3, not all the cross-sectional slices are the same in shape.

Figure 5D:
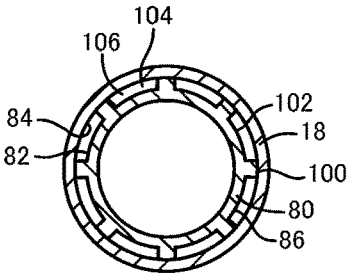
FIG. 5D is a cross-sectional view of one of cross-sectional slices of the cartridge depicted in FIG. 5C, which includes one of the ridge segments or one of the spacers (or one of the solid elements)

More specifically, as illustrated in FIG. 5D, for one of the plurality of cross-sectional slices that has one of the ridge segments 108, the annular region has a plurality of first air gaps (the plurality of grooves 102) together with a plurality of first solid elements (the plurality of ridges 100) circumferentially aligned with the first air gaps, as illustrated in FIG. 5D.

Figure 5E:
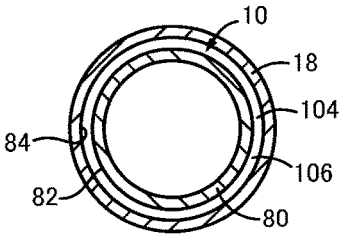
FIG. 5E is a cross-sectional view of one of cross-sectional slices of the cartridge depicted in FIG. 5C, which includes one of the air gaps axially adjacent the aforementioned one of the spacers (or one of the solid elements).

In contrast, as illustrated in FIG. 5E, for another cross-sectional slice axially adjacent to the aforementioned cross-sectional slice, that is, a cross-sectional slice having none of the ridge segments 108, the annular region has a single second air gap continuously extending circumferentially (the plurality of grooves 102 combined with a plurality of chasms (interspaces each of which is between adjacent two ridge segments 108)), without having any second solid elements circumferentially aligned, in fluid communication with the plurality of first air gaps.

In the example depicted in FIG. 5C, the plurality of first air gaps and the plurality of second air gaps lying over the plurality of cross-sectional slices together form a single axially-continuous clearance 106 continuously extending in directions including not only an axial component but also a circumferential component, unlike the example depicted in FIG. 3.

It is noted that the plurality of ridge segments 108 may be replaced with a plurality of dot-like raised portions (e.g., hemispheric, conical, cylindrical), and these dot-like raised portions may be discretely aligned along generators to form one-dimensional arrays of the raised portions, or may be dispersed on the outer circumferential surface 82 of the plunger 10 and/or the inner circumferential surface 84 of the cylinder 18 both axially and circumferentially to form a two-dimensional array of the raised portions.

In this arrangement, each dot-like raised portion functions as the spacer, and portions of the annular region exclusive of the dot-like raised portions function as a single axially-continuous clearance 106. In this case, the axially-continuous clearance 106 extends continuously both axially and circumferentially.

As illustrated in FIG. 3C, in the present embodiment, the plunger 10 adopts a hollow structure; the circumferential wall 86 of the main body portion 80 elastically deforms in the radial direction more easily than in case it adopts a solid structure.

In the present embodiment, the plunger 10 is radially deformable at its ridges 100; due to this, when the tip ends of the multiple ridges 100 contact the inner circumferential surface 84 of the cylinder 18, the ridges 100 elastically deform radially inwardly. As a result, the multiple ridges 100 are prevented from strongly contacting the inner circumferential surface 84 of the cylinder 18.

As illustrated in FIG. 3B, in the present embodiment, the cross section of each ridge 100 is a cross section having a generally rectangular shape.

In some other examples, the cross section of each ridge 100 may have a cross section with another shape, for example, a cross section that tapers radially outwardly (a cross section generally shaped as a triangle, hemisphere or trapezoid).

In these other examples, the circumferential fluidity of the viscous material 14 is higher when the cross section of each ridge 100 is generally shaped as a triangle, hemisphere or trapezoid, thereby facilitating the filling of the radial clearance between the tip end surface of each ridge 100 and the inner circumferential surface 84 of the cylinder 18 with the viscous material 14, than in cases in which the cross section of each ridge 100 is generally rectangular shaped.

As illustrated in FIG. 3B, in the present embodiment, the cross section of each groove 102 is a cross section having a generally rectangular shape.

In some other examples, each groove 102 may have a cross section with another shape, for example, a cross section that tapers radially inwardly (a cross section generally shaped as a triangle, hemisphere or trapezoid). In one example, each ridge 100 has a cross section that tapers radially outwardly, while each groove 102 has a cross section that tapers radially inwardly.

As illustrated in FIG. 3B, in the present embodiment, in case the inner circumferential surface 84 of the cylinder 18 has a circular cross-section, if the outer circumferential surface 82 of the plunger 10 has a circular cross-section, outer outlines of respective segments that constitute a profile (shape), which represents the cross section obtained by transversely cutting the multiple ridges 100 at one axial position, are located on a perfect circle that is concentric with the plunger 10, thereby allowing these outer outlines to be described as a plurality of arcs sharing a single center.

In another example, although not shown, in case the inner circumferential surface 84 of the cylinder 18 has a circular cross-section, if the outer circumferential surface 82 of the plunger 10 has a non-circular cross-section, multiple outer outlines corresponding to the multiple ridges 100 are located on a single non-circular endless-line (e.g., an oval, an ellipse, a polygon) that is concentric with the plunger 10.

Next, the plunger 10 will be described with regard to its aspect ratio (height to length ratio) taken in side view.

An axial dimension that represents the plunger 10 (e.g., in FIG. 3C, the axial length from the edge position of the circumferential wall 86 on the side of the filling chamber 72 to the edge position on the side of the pressurizing chamber 74) is larger than a diametrical dimension that represents the same plunger 10 (e.g., in FIG. 3B, the diameter of the circle that circumscribes the silhouette obtained by projecting the plunger 10 in the axial direction). When the pressurized gas acts, the maximum value of the angle that the plunger 10 unintentionally tilts within the cylinder 18 due to the pressurized gas decreases by such a dimensional effect.

The aspect ratio, which is the ratio of the axial dimension, which represents the plunger 10, to the diametrical dimension, which represents the same plunger 10, may be about 1 or more, about 1.2 or more, or about 1.5 or more; as this aspect ratio becomes bigger, the anti-tilting effect of the plunger 10 within the cylinder 18 increases.

Next, referring to FIGS. 7-11, a filling method that fills the viscous material 14 into the cartridge 12 will be described.

Figure 7:
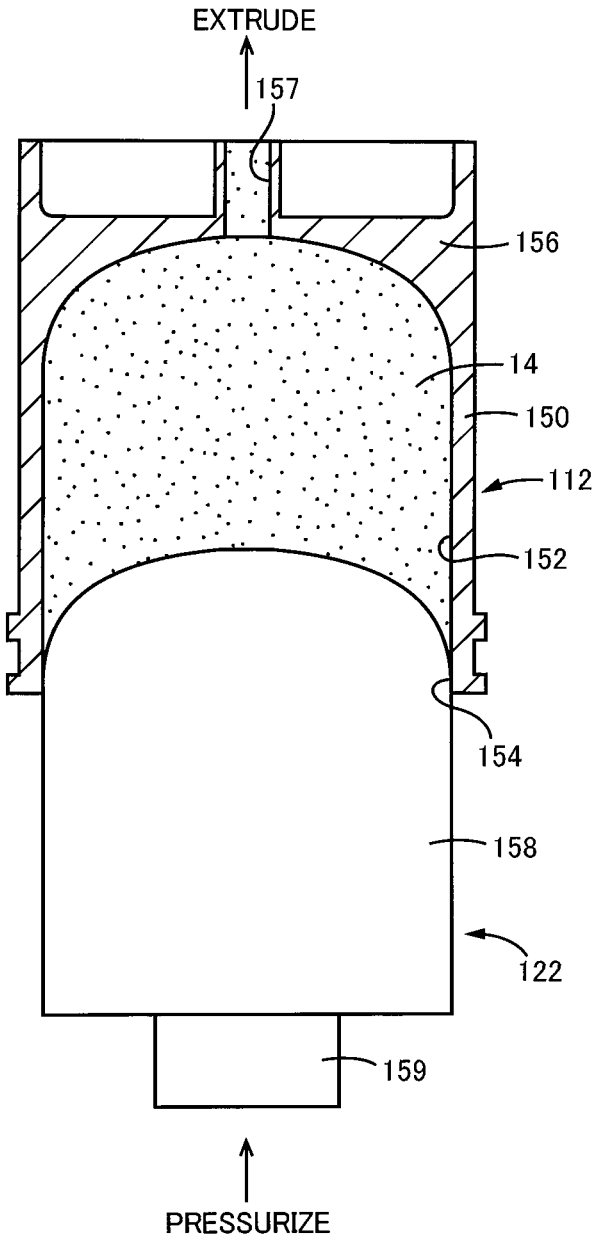
FIG. 7 is a cutaway cross-sectional side view illustrating a container set of a filling device for use in effecting a filling method for filling the cartridge depicted in FIG. 2 with the viscous material, the container set being constructed by inserting a pusher piston into a container.

Prior to filling of the cartridge 12, the viscous material 14 is produced and stored in the container 112 depicted in FIG. 7. Then, the viscous material 14 that has been stored in the container 112 is dispensed from the container 112 into a plurality of cartridges 12. The viscous material 14 is extruded from the container 112 as the pusher piston 122 is forced into the container 112. The extruded viscous material 14 is filled into the cylinder 18.

FIG. 7 illustrates the container 112 in a cross-sectional side view. In the present embodiment, the same container 112 is used for the production of the viscous material 14 (two-component mixing, as described below), the degassing of the viscous material 14 (centrifugal vacuum degassing using a mixer, as described below) after the production thereof, the storage and transportation of the viscous material 14 prior to filling into the cartridge 12, and the filling to the cartridge 12.

As FIG. 7 illustrates, the container 112 has a longitudinally-extending hollow housing 150 and a cylindrical chamber 152 that is formed coaxially within the housing 150. The chamber 152 has an opening 154 and a base portion 156. The base portion 156 has a recess that forms a generally hemispherical shape. Because the base portion 156 has a continuous shape, the viscous material 14 flows in the chamber 152 more smoothly than if the base portion 156 had a flat shape; as a result, the mixing efficiency of the viscous material 14 is improved. An example of a material constituting the container 112 is POM (polyacetal); another example is Teflon (registered trademark), although these are not limiting.

In the base portion 156 of the chamber 152, a discharge passage 157 is formed for discharging the viscous material 14 (a mixture of Solutions A and B), which is contained within the chamber 152, into the cylinder 18; the discharge passage 157 is selectively closed by a removable plug (not shown).

As illustrated in FIG. 7, the pusher piston 122 is pushed into the chamber 152 of the container 112 in order to discharge the viscous material 14 from the container 112. The pusher piston 122 has a main body portion 158 and an engagement portion 159 formed at the rear end of the main body portion 158. The main body portion 158 has an exterior shape that is complementary to the interior shape of the chamber 152 of the container 112 (e.g., an exterior shape having a protrusion that forms a generally hemispherical shape). The engagement portion 159 is smaller in diameter than the main body portion 158; when an external force is loaded by a filling device 210 (see FIG. 10), the pusher piston 122 advances. As the pusher piston 122 moves within the chamber 152 closer to the discharge passage 157, the viscous material 14 is extruded from the discharge passage 157.

Figure 8:
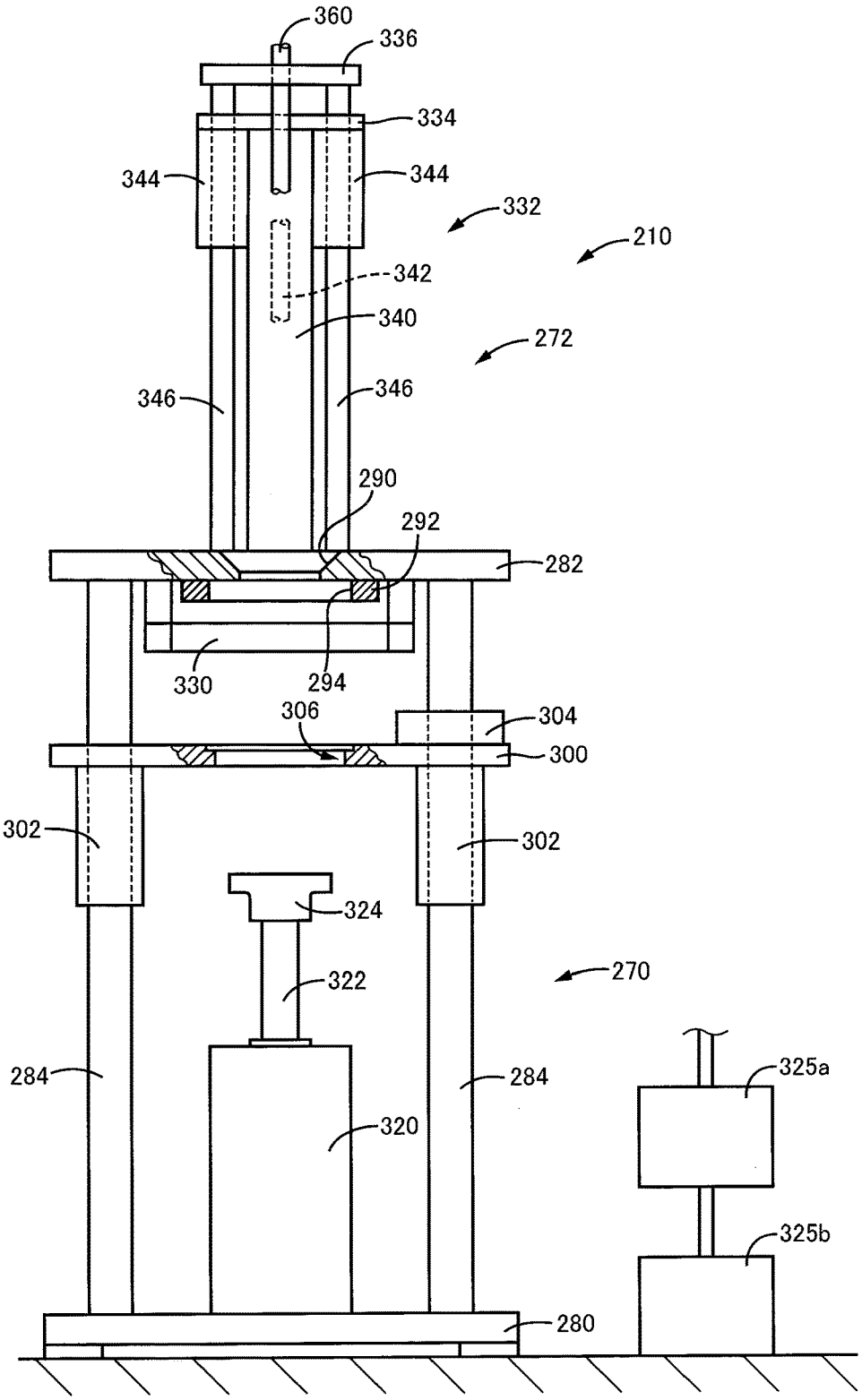
FIG. 8 is a cutaway cross-sectional front view illustrating the filling device.
Figure 9:
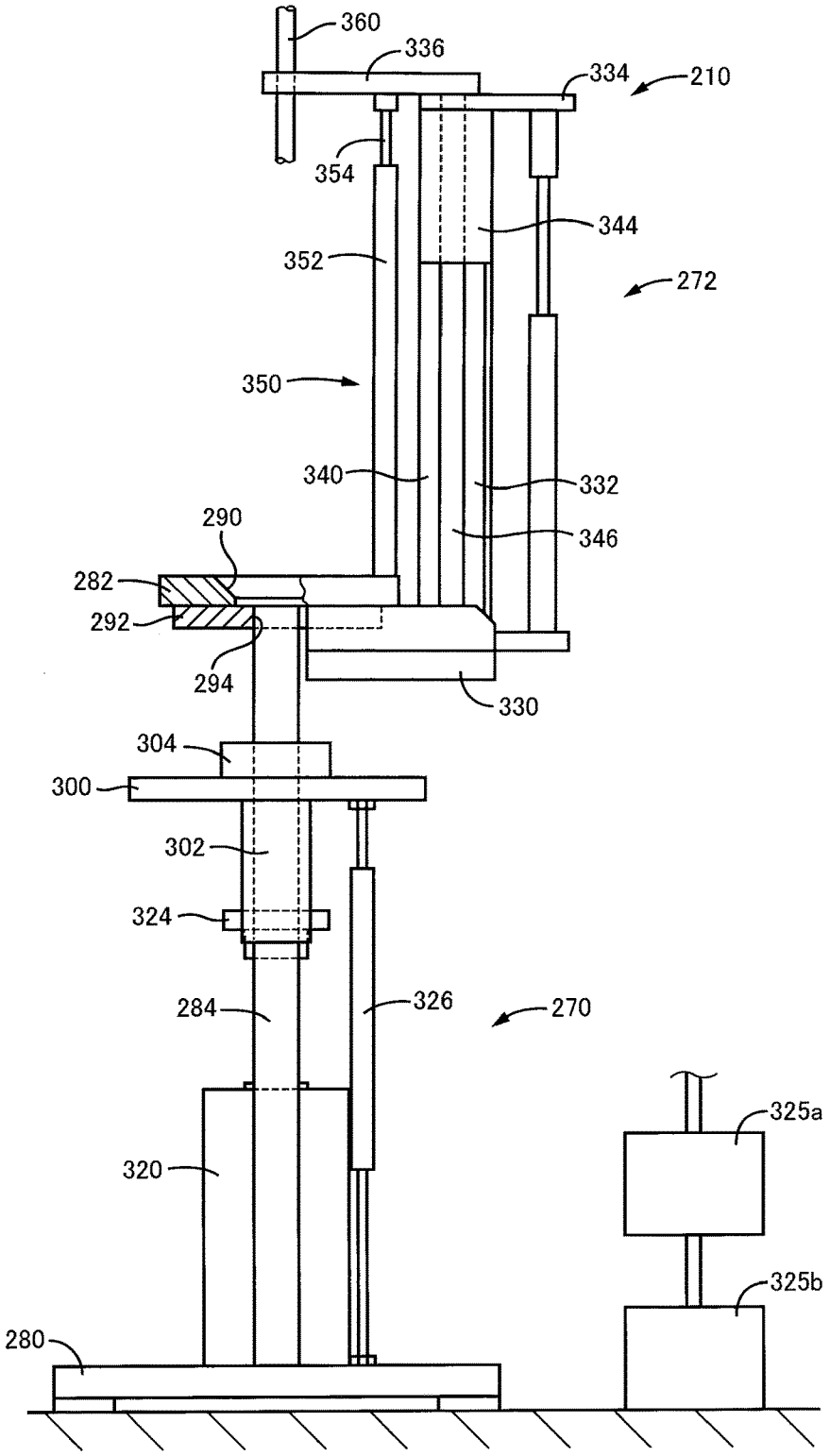
FIG. 9 is a cutaway cross-sectional side view illustrating the filling device.
Figure 10:
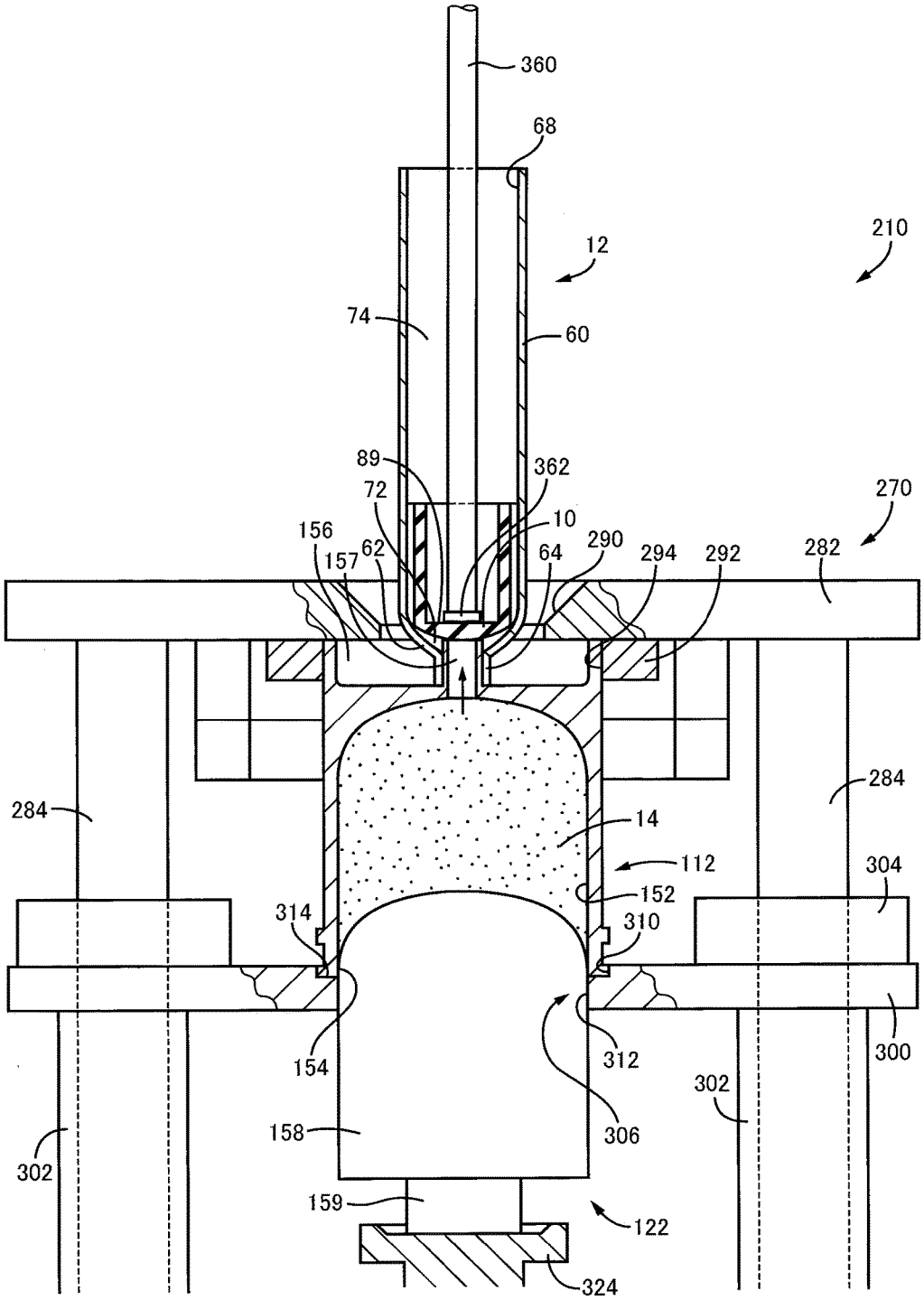
FIG. 10 is a cutaway cross-sectional front view illustrating a relevant portion of the filling device when in use.

FIG. 8 illustrates the filling device 210, which is for use in transferring the viscous material 14 from the container 112 to the cartridge 12, thereby filling the cartridge 12 with the viscous material 14, FIG. 9 illustrates the filling device 210 in a cutaway cross-sectional side view. FIG. 10 illustrates a relevant portion of the filling device 210 when in use in a cutaway cross-sectional front view in enlargement.

In the present embodiment, while transferring the viscous material 14 from the container 112 to the cartridge 12, the container 112 is held in space, as illustrated in FIG. 10, such that the container 112 is oriented with the opening 154 of the chamber 152 facing downward and the discharge passage 157 of the base portion 156 facing upward (upside-down position). In this state, the pusher piston 122 is moved upwardly within the chamber 152. As a result, the viscous material 14 is upwardly extruded from the chamber 152.

Furthermore, while transferring the viscous material 14 from the container 112 to the cartridge 12, the cartridge 12 is held in space with the opening 68 facing upward and with the base portion 62 facing downward. In this state, when the viscous material 14 is upwardly extruded from the container 112, it is injected via the base portion 62 of the cartridge 12.

As FIGS. 8 and 9 illustrate, the filling device 210 at its lower portion has a container holder mechanism 270 that removably holds the container 112; on the other side, the filling device 210 at its upper portion has a cartridge holder mechanism 272 that removably holds the cartridge 12.

The container holder mechanism 270 has a base plate 280, which sits on the ground, a top plate 282, which is not vertically movable and is located above the base plate 280, and a plurality of vertical parallel shafts 284, each of which is fixedly secured at its two ends to the base plate 280 and the top plate 282 (in the present embodiment, as illustrated in FIGS. 8 and 9, two shafts disposed symmetrically relative to a vertical centerline of the container holder mechanism 270). The top plate 282 has a through hole 290. The through hole 290 is coaxial with the vertical centerline of the container holder mechanism 270.

A guide plate 292 is fixedly secured to a lower face of the top plate 282. The guide plate 292 has a guide hole 294 coaxial with the through hole 290. The guide hole 294 penetrates through the guide plate 292 in the thickness direction with a uniform cross-section. The guide hole 294, as illustrated in FIG. 10, has an inner diameter that is slightly larger than the outer diameter of the base portion 156 of the container 112, and it is possible to fit the container 112 within the guide hole 294 without any noticeable play. Due to the guide hole 294, the container 112 is aligned relative to the top plate 282 in the horizontal direction (the radial direction of the container 112).

As FIG. 10 illustrates, when the base portion 156 of the container 112 is in the state that it is fitted in the guide hole 294, the container 112 at a tip end surface of the base portion 156 (in the same flat plane) abuts on the lower surface of the top plate 282. As a result, the container 112 can be aligned relative to the top plate 282 in the vertical direction (the axial direction of the container 112).

As FIGS. 8 and 9 illustrate, the container holder mechanism 270 further has a vertically movable plate 300. The movable plate 300 has a plurality of sleeves 302, into which the shafts 284 are axially slidably fitted. By manipulating a lock mechanism 304, the operator can move the movable plate 300 and stop the movement in any position in the vertical direction.

The movable plate 300 has a stepped positioning hole 306 coaxial with the guide hole 294. The positioning hole 306 penetrates through the movable plate 300 in the thickness direction. As FIG. 10 illustrates, the positioning hole 306 has a larger-diameter hole 310 on the side closer to the guide hole 294, a smaller-diameter hole 312 on the opposite side, and a shoulder surface 314 located between the larger-diameter hole 310 and the smaller-diameter hole 312 and facing towards the guide hole 294.

The larger-diameter hole 310 has an inner diameter that is slightly larger than the outer diameter of the opening 154 of the container 112 and the container 112 is aligned relative to the movable plate 300 (and therefore the top plate 282) in the horizontal direction (the radial direction of the container 112).

The tip end surface of the opening 154 of the container 112 (in the same flat plane) abuts on the shoulder surface 314, and the container 112 is aligned relative to the movable plate 300 (therefore the top plate 282) in the vertical direction (the axial direction of the container 112).

The smaller-diameter hole 312 has an inner diameter that is slightly larger than the outer diameter of the pusher piston 122, and the pusher piston 122 is slidably fitted into the smaller-diameter hole 312. The smaller-diameter hole 312 serves as a guide hole for guiding axial movement of the pusher piston 122.

A container set is constructed by inserting the pusher piston 122 into the container 112, and the container set is attached to the top plate 282, with the movable plate 300 sufficiently spaced from the top plate 282 in the downward direction. Thereafter, the movable plate 300 is upwardly moved until the tip end face of the opening 154 of the container 112 abuts on the shoulder surface 314. At this position, the movable plate 300 is fixedly secured to the shafts 284. As a result, the retention of the container set on the container holder mechanism 270 is completed.

As FIGS. 8 and 9 illustrate, the container holder mechanism 270 further has an air cylinder 320 serving as an actuator and coaxial with the guide hole 294. A rod 322, which serves as a vertically movable member, upwardly projects from the air cylinder 320, and a pusher 324 is affixed at the tip end of the rod 322. The pusher 324, as illustrated in FIG. 10, engages with the engagement portion 159 of the pusher piston 122 of the container set that is held in the container holder mechanism 270. In the engagement position, as the pusher 324 advances, the pusher piston 122 advances relative to the container 112 so as to reduce the volume of the chamber 152.

The air cylinder 320 is double-acting and, based on the operator's actions, the pusher 324 thereof selectively advances from an initial position to an active position (upward movement by pressurization), retreats from the active position to an inactive position (downward movement by pressurization), and stops at any desired position (inhibiting gas release from both gas chambers within the air cylinder 320). The air cylinder 320 is connected to a high-pressure source (its primary pressure is, e.g., 0.2 MPa) 325*b* via a hydraulic pressure control unit 325*a* having flow control valve(s).

As FIG. 9 illustrates, the container holder mechanism 270 further has a gas spring 326 serving as a damper. The gas spring 326 extends vertically and is pivotably coupled at its two ends with the base plate 280 and the movable plate 300, respectively. The gas spring 326 is provided to restrict the downward movement of the movable plate 300 due to gravity when the lock mechanism 304 is in an unlocked position.

As FIGS. 8 and 9 illustrate, the cartridge holder mechanism 272 is equipped with a base frame 330 that is fixedly secured to the top plate 282, an air cylinder 332 serving as an actuator, a top frame 334 and a movable frame 336.

The air cylinder 332 has a vertically-extending main body 340, which is fixedly secured to the top plate 282 and the top frame 334, and a vertically-movable rod 342 that is linearly movable relative to the main body 340. The upper end of the vertically-movable rod 342 (the end of the vertically-movable rod 342 that projects from the main body 340) is fixedly secured to the movable frame 336.

The air cylinder 332 is double acting, and based on operator's actions, the vertically-movable rod 342 thereof selectively advances from an initial position to an active position (upward movement by pressurization), retreats from the active position to an inactive position (downward movement by pressurization), and floats at any desired position (permitting gas release from both gas chambers in the air cylinder 332). That is, the air cylinder 332 can selectively switch between an advanced mode, a retracted mode and a floating mode. The air cylinder 332 is connected to the high-pressure source 325*a* via a hydraulic pressure control unit 325*a*.

A plurality of sleeves 344 (in the present embodiment, two parallel sleeves disposed symmetrically with the air cylinder 332 interposed therebetween) is fixedly secured to the main body 340. A plurality of vertically-extending shafts 346 is slidably fitted into the respective sleeves 344. The upper end portion of each shaft 346 is fixedly secured to the movable frame 336.

Each of the base frame 330, the top frame 334, the main body 340 and the sleeves 344 is a stationary member in the cartridge holder mechanism 272, while the movable frame 336, the vertically-movable member 142, and the shafts 346 are each movable members that vertically move in unison.

As FIG. 9 illustrates, the cartridge holder mechanism 272 is further equipped with a gas spring 350 serving as a damper. The gas spring 350 extends vertically between the base frame 330 and the movable frame 336. The gas spring 350 is equipped with a cylinder 352 having a gas chamber (not shown), and a rod 354 that is extendable and retractable relative to the cylinder 352. At one end thereof, the cylinder 353 is pivotably coupled to the base frame 330.

A tip end of the rod 354 detachably engages a lower surface of the movable frame 336. As a result, although the movable frame 336 can compress the rod 354, it cannot extend the rod 354. When in a compressed state, the rod 354 applies an upward force against the movable frame 336, which assists the upward movement of the movable frame 336.

In the present embodiment, the container 112 and the cartridge 12 are directly coupled together, e.g., by screwing together male and female threads, with the container 112 retained in the filling device 210, and the cartridge 12 is aligned relative to the container 112 in both of the radial direction and the axial direction.

As FIG. 10 illustrates, a rod 360 is inserted into the cartridge 12, with the aforementioned container set held by the container holder mechanism 270, and with the aforementioned container set coupled to the cartridge 12.

The rod 360 is held by the cartridge holder mechanism 272. In the present embodiment, the cartridge holder mechanism 272 holds the rod 360 and the rod 360 is, in turn, inserted into the cartridge 12; consequently, the cartridge 12 is held by the cartridge holder mechanism 272.

The rod 360 is in the form of a tube which extends linearly and is rigid. The rod 360 is a steel pipe (can be replaced with a plastic pipe) and is capable of transmitting compressive forces in the axial direction.

The rod 360 has a tip end surface at which the rod 360 is closed in an air-tight manner by a stop 362. The stop 362 at its tip end surface is in abutment with an interior surface 89 of the plunger 10, which sets a definite approaching limit of the rod 360 relative to the plunger 10.

As FIG. 10 illustrates, by pushing the pusher piston 122 into the container 112, the viscous material 14 is extruded from the container 112 via the base portion 156, and the extruded viscous material 14 fills the filling chamber 72. As the volume of viscous material 14 filling the filling chamber 72 increases, the plunger 10 is further displaced by the viscous material 14 and moves upwardly relative to the cylinder 18. With this, the rod 360 moves upwardly relative to the cartridge 12.

As FIGS. 8 and 9 illustrate, the rod 360 is fixedly secured to the movable frame 336. The rod 360 extends coaxially with the vertical centerline of the filling device 210 (coaxial with the centerline of the guide hole 294). Owing to the filling device 210, the cartridge 12 is aligned relative to the top plate 282.

Next, the filling method will be described in more detail with reference to the process flowchart depicted in FIG. 11, which is followed by description of how to prepare the viscous material 14.

The viscous material 14 is a high-viscosity synthetic resin, and exhibits thermosetting properties, such that the viscous material 14 cures when heated above a prescribed temperature (e.g., 50° C.); once cured, the original properties of the viscous material 14 will not be restored even if the temperature decreases. When the viscous material 14 is cooled below a prescribed temperature (e.g., −20° C.) prior to curing and is frozen, the chemical reaction (curing) in the viscous material 14 stops. Thereafter, the viscous material 14 also exhibits the property that, when the viscous material 14 is heated and thawed, the chemical reaction (curing) in the viscous material 14 restarts.

In the present embodiment, the viscous material 14 is a two-part mix type that is furnished by mixing two solutions, which are "Solution A" (curing agent) and "Solution B" (major component). An example of "Solution A" is PR-1776 B-2, Part A (i.e., an accelerator component, and a manganese dioxide dispersion) of PRC-DeSoto International, U.S.A., and an example of "Solution B," which is combined with Solution A, is PR-1776 B-2, Part B (i.e., a base component, and a filled modified polysulfide resin) of PRC-DeSoto International, U.S.A.

Therefore, as FIG. 11 illustrates, in order to produce the viscous material 14, the two parts are first mixed in the container 112 in step S11. Next, in step S12, agitating and degassing are performed on the viscous material 14 held in the container 112 using a mixer (not shown). In the present embodiment, the same container 112 is used to mix the two parts for the production of the viscous material 14, and to agitate and degas the viscous material 14 using the mixer.

An example of such a mixer is disclosed in Japanese Patent Application Publication No. H11-104404, the content of which is incorporated herein by reference in its entirety. In the present embodiment, such a mixer is used to orbit the container 112 around an orbital axis and simultaneously rotate the container 112 about a rotational axis that is eccentric to the orbital axis, with the container 112 filled with the viscous material 14 under a vacuum, so that the viscous material 14 can be simultaneously agitated and degassed within the container 112.

The viscous material 14 within the mixer is agitated due to the centrifugal force created by the planetary motion produced by the mixer. Further, air bubbles trapped in the viscous material 14 are released from the viscous material 14, due to the synergistic effect of the centrifugal force generated by the planetary motion of the mixer and the negative pressure caused by the vacuum atmosphere; as a result, the viscous material 14 is degassed. This completely or adequately prevents generation of voids within the viscous material 14.

After the viscous material 14 has been mixed and agitated/degassed within the container 112 in the manner described above, an operation that transfers and fills the viscous material 14 from the container 112 into the cartridge 12 starts as illustrated in FIG. 10.

In step S21, the operator first inserts the pusher piston 122 into the container 112 that has been filled with the viscous material 14, as illustrated in FIG. 7, to thereby prepare the container set.

Next, in step S22, the operator attaches the container set to the container holder mechanism 270 of the filling device 210 with the container set inverted, as illustrated in FIG. 10, to thereby retain the container set in the filling device 210.

More specifically, prior to the retention of the container set in the container holder mechanism 270, the movable plate 300 is retreated downwardly from the container set. The operator first puts the container set on the retreated movable plate 300 at a prescribed position and in an inverted orientation. Thereafter, the operator raises the movable plate 300 together with the container set until the container 112 abuts on the top plate 282. Lastly, the operator fixes the movable plate 300 at that position.

Subsequently, in step S23, the operator inserts the plunger 10 into the cartridge 12 as illustrated in FIG. 10, to thereby prepare the cartridge 12.

Thereafter, in step S24, the cartridge 12 is coupled to the container set, which was previously retained by the filling device 210 in an inverted orientation, in a substantially air-tight manner, as illustrated in FIG. 10, thereby retaining the cartridge 12 in the filling device 210.

Prior to the attachment of the cartridge 12 to the filling device 210, the air cylinder 332 is placed in the aforementioned advanced mode, in which the vertically-movable rod 342 is pushed out; as a result, the rod 360 is in a position that is upwardly retreated from the cartridge 12. In other words, the rod 360 does not obstruct the attachment of the cartridge 12 to the filling device 210.

Subsequently, in step S25, the air cylinder 332 is switched to the aforementioned retracted mode to retract the vertically-movable rod 342 and to thereby insert the retreated rod 360 into the cartridge 12. The rod 360 is downwardly moved by the air cylinder 332 until the stop 362 of the rod 360 abuts on the plunger 10, which was previously put into the cartridge 12. An advancing limit of the plunger 10 is defined by, for example, abutting on a tip end portion of a portion, which forms the discharge passage 157, within the base portion 156 of the container 112.

Thereafter, the air cylinder 332 is switched to the aforementioned floating mode; as a result, if the assistance by the gas spring 350 is disregarded, the force acting on the plunger 10 from the rod 360 has a value equal to the summation of the weight of the rod 360 and the weight of member(s), which move together with the rod 360, minus the value of the sliding resistance. This force is a force acting in the direction that urges the plunger 10 in the direction towards the base portion 62 of the cartridge 12, and is a force acting in the direction that reduces the volume of the filling chamber 72.

Thereafter, in step S26, the pusher piston 122 rises and is pushed into the container 112, as illustrated in FIG. 10. With this, the viscous material 14 is extruded from the container 112 against the force of gravity, to thereby initiate the filling of the filling chamber 72.

When the viscous material 14 flows from the container 112 into the filling chamber 72 of the cartridge 12, air present within the filling chamber 72 is compressed by the in-flowing viscous material 14.

As a result, a pressure differential is generated within the cartridge 12, because the filling chamber 72 is at a higher pressure than the pressurizing chamber 74 (at atmospheric pressure), which is in communication with outside of the cartridge 12. Due to this pressure differential, air within the filling chamber 72 flows into the pressurizing chamber 74 via the radial clearances between the plunger 10 and the cylinder 18 (while the seal 104 has not yet completed), and consequently, it is discharged from the opening 68 of the cartridge 12 to the outside. This allows the air in the filling chamber 72 to be degassed.

As a result, according to the present embodiment, during the filling of the viscous material 14 into the filling chamber 72, the air is discharged from the filling chamber 72, air is prevented from being incorporated into the viscous material 14 within the filling chamber 72, and co-existence of the viscous material 14 and air within the filling chamber 72 is prevented.

Further, according to the present embodiment, a force is applied to the plunger 10 within the cartridge 12 by the rod 360 in the direction that reduces the volume of the filling chamber 72. The applied force is a force with the direction that displaces the plunger 10 towards the viscous material 14 that has flowed into the cartridge 12.

For these reasons, according to the present embodiment, also due to the application of the aforementioned force by the rod 360, the above-mentioned pressure differential is created and the pressure differential, which is generated within the cartridge 12, is larger than if a force were not applied by the rod 360. A phenomenon is thereby promoted that air present within the filling chamber 72 flows into the pressurizing chamber 74 through the radial clearances between the plunger 10 and the cylinder 18.

Thereafter, the entire filling chamber 72, which is in the initial state depicted in FIG. 10 (in which the plunger 10 is located at its lowermost position), is filled with the viscous material 14 (replacing all the air initially present within the filling chamber 72 with viscous material 14). Subsequently, as the filling of the viscous material 14 continues, the volume of the filling chamber 72 increases and the plunger 10, the rod 360 and the movable frame 336 attempt to rise.

At this moment, a first portion of the viscous material 14 within the filling chamber 72 is consumed to form the seal 104; when the seal 104 is completed, the rest of the viscous material 14 from leaking into the pressurizing chamber 74 is prevented by the seal 104. Viscous material blocking is performed by the seal 104.

In the present embodiment, the viscous material 14 is filled into the plunger 10 via not the opening 68 but the discharge port 67, thereby, in an initial period from the start of the filling operation, creating a layer of air (an upper layer) closer to the plunger 10 in the filling chamber 72, and a layer of the viscous material 14 below the layer of air. As a result, as long as air is present within the filling chamber 72, the viscous material 14 is prevented from being brought into contact with the plunger 10.

When the viscous material 14 rises up in the filling chamber 72 and the filling chamber 72 is fully degassed, the viscous material 14 is brought into contact with the plunger 10 and enters the clearances between the plunger 10 and the cylinder 18. As a result, the seal 104 is created between the plunger 10 and the cylinder 18 for performing the aforementioned blockage of the viscous material 14. After the completion of the seal 104, bi-directional air-leakage is also inhibited.

Prior to the filling of the viscous material 14 into the cartridge 12, the gas spring 350 depicted in FIG. 9 is in a compressed state due to the movable frame 336. As a reaction thereto, the gas spring 350 applies a force to the movable frame 336 that lifts the movable frame 336 together with the rod 360.

Therefore, after the entire filling chamber 72, which is in the initial state depicted in FIG. 10 (the plunger 10 is located at its lowermost position), is filled with the viscous material 14, and when the volume of the filling chamber 72 further increases, it is thereby possible to raise the plunger 10, the rod 360 and the movable frame 336 without increasing much the pressure of the viscous material 14 within the filling chamber 72.

In other words, in step S27, the lifting of the rod 360 and the movable frame 336 is mechanically assisted by the gas spring 350.

Thereafter, in step S28, it is waited for the amount of the viscous material 14 that has filled into the cylinder 18 to reach a prescribed value, and for the rod 360 to rise up to a prescribed position. If the rod 360 rises up to the prescribed position, then the air cylinder 320 makes a shift to stop further advance of the pusher piston 122, which is followed by an action in which the air cylinder 332 extends the vertically-movable rod 342, thereby lifting the rod 360 with the plunger 10 remaining in the cartridge 12, and retracting the rod 360 from the cartridge 12.

Subsequently, in step S29, the operator removes the cartridge 12 from the container 112 and the filling device 210.

Thereafter, in step S30, the operator removes the container set from the filling device 210.

Then, the transferring and filling of the viscous material 14 from one unit of the container 112 to one unit of the cartridge 12 is completed.

The above-mentioned exemplary viscous-material filling method is disclosed in U.S. Pat. No. 9,126,702, the content of which is incorporated herein by reference in its entirety.

Next, functions and results provided by the present embodiment will be explained in an exemplary manner.

1. Self-Sealing Function

According to the present embodiment, when the plunger 10 is fitted into the cylinder 18, the axially-continuous clearances 106 are created between the outer circumferential surface 82 of the plunger 10 and the inner circumferential surface 84 of the cylinder 18. The axially-continuous clearances 106 permit gas and the viscous material 14 from flowing from the filling chamber 72 to the pressurizing chamber 74.

In a state in which the axially-continuous clearances 106 have been created between the outer circumferential surface 82 of the plunger 10 and the inner circumferential surface 84 of the cylinder 18, when the viscous material 14 is filled into the filling chamber 72 within the cylinder 18 from the outside, the axially-continuous clearances 106 are filled with a portion of the viscous material 14. The axially-continuous clearances 106 which have been filled with the portion of the viscous material 14 serves as the seal 104.

To sum up, according to the present embodiment, the cartridge 12 provides a so-called self-sealing function, i.e., the function of allowing a portion of the viscous material 14 that is a substance serving as a filler and to be discharged, to serve as the seal 104 by itself.

As a result, according to the present embodiment, in the filling phase of the viscous material 14 into the cylinder 18, prior to completion of the seal 104, gas flow from the filling chamber 72 to the pressurizing chamber 74, i.e., intentional venting (i.e., degassing or deaeration of the viscous material 14 within the filling chamber 72) is achieved. Further, after completion of the seal 104, flow of the viscous material 14 from the filing chamber 72 to the pressurizing chamber 74, i.e., unintentional viscous-material leakage is prevented. Furthermore, in the discharge phase of the viscous material 14, gas flow of pressurized air from the pressurizing chamber 74 to the filling chamber 72, i.e., unintentional gas leakage is prevented throughout this entire stage.

2. Smooth Sliding Action of the Plunger

Further, according to the present embodiment, when one of the cross-sectional slices of the cartridge 12 is viewed, there is no possibility that the outer circumferential surface 82 of the plunger 10 and the inner circumferential surface 84 of the cylinder 18 are in contact with each other at that position around the entire circumference; only portion(s) in the circumferential direction, i.e. the solid element(s) or the spacer(s), is/are in contact.

Therefore, when one of the cross-sectional slices of the cartridge 12 is viewed, the contact area, in each slice, between the outer circumferential surface 82 of the plunger 10 and the inner circumferential surface 84 of the cylinder 18 is smaller than the aforementioned known cartridge (i.e., the dispenser having the aforementioned circumferential lands), in which the outer circumferential surface 82 of the plunger 10 and the inner circumferential surface 84 of the cylinder 18 are in contact with each other at that position over the entire circumference; therefore, sliding frictional resistance generated when the two relatively displace in the axial direction is reduced.

Therefore, according to the present embodiment, in the discharge phase of the viscous material 14 from the cartridge 12, the plunger 10 is facilitated to slide relative to the cylinder 18 more smoothly than when the aforementioned circumferential lands are used.

As a result, when an advancing force or a driving force acts on the plunger 10 in order to discharge the viscous material 14, a tilting moment unintentionally acts on the plunger 10 and the plunger 10 tilts relative to the cylinder 18; even if the plunger 10 locally contacts the cylinder 18, the risk of the plunger 10 being stuck at the same axial position is reduced. That is, the phenomenon of the plunger 10 being stuck in the cylinder 18 due to tilting of the plunger 10 is prevented.

If the plunger 10 is prevented from being stuck, it is prevented from being subject to an excessive rise in an axial force on the plunger 10 (e.g., an excessive rise in the rear pressure of the plunger 10 in the cartridge 12 for a pneumatic plunger), it is also prevented from experiencing a larger tilting moment, it is still also prevented from overly tilting relative to the cylinder 18, and therefore, it is yet also prevented from locally strongly contacting the cylinder 18.

As a result, in the discharge phase of the viscous material 14 from the cartridge 12, the completed seal 104 is prevented from be locally cracked due to the tilting of the plunger 10. If the generation of such cracks is prevented, unintentional gas leakage from the pressurizing chamber 74 to the filling chamber 72 is avoided.

Therefore, in the discharge phase of the viscous material 14 from the cartridge 12, the tendency of the plunger 10 to unintentionally tilt relative to the cylinder 18 is restricted, thereby eliminating the possibility that gas bubbles are entrapped in the viscous material 14 within the filling chamber 72 due to tilting of the plunger 10.

3. Dynamic Stabilization of the Plunger Attitude Owing to the Snug Fit

Further, according to the present embodiment, when one of the cross-sectional slices of the cartridge 12 is viewed, there is the possibility that the outer circumferential surface 82 of the plunger 10 and the inner circumferential surface 84 of the cylinder 18 are in contact with each other at that position, at least temporarily (e.g., substantially constantly). In other words, as described above, the cartridge 12 utilizes a snug fit as the fitting method.

In contrast thereto, in order to further reduce the sliding frictional resistance between the plunger 10 and the cylinder 18, it is conceivable to apply a countermeasure in that the plunger 10 is loosely fitted into the cylinder 18, such that the outer circumferential surface 82 of the plunger 10 and the inner circumferential surface 84 of the cylinder 18 are brought into contact with each other less frequently than in the cartridge 12 according to the present embodiment.

When such a loose-fit countermeasure is adopted, however, the tendency of the plunger 10 being laterally displaced within the cylinder 18 and the tendency of the plunger 10 tilting relative to the cylinder 18 during operation of the dispenser 20 are so large that the relative dynamic attitude of the plunger 10 within the cylinder 18 might not be stable.

In contrast thereto, according to the present embodiment, because it is possible to implement a possible mode in which the outer circumferential surface 82 of the plunger 10 and the inner circumferential surface 84 of the cylinder 18 contact each other via the solid element(s) or the spacer(s), at least temporarily (e.g., substantially constantly), the plunger 10 is laterally supported by the cylinder 18 via these solid element(s) or the spacer(s), thereby improving the stability in the relative dynamic attitude of the plunger 10 within the cylinder 18.

4. Reduction of Viscous Material Required for the Seal

Further, in case such a loose-fit countermeasure is adopted, a continuous clearance is created entirely circumferentially between the outer circumferential surface 82 of the plunger 10 and the inner circumferential surface 84 of the cylinder 18.

In contrast thereto, according to the present embodiment, the continuous clearances 106 are created not entirely but less circumferentially between the outer circumferential surface 82 of the plunger 10 and the inner circumferential surface 84 of the cylinder 18. Owing to that, the total volume of the continuous clearances 106, that is, the fill amount of the viscous material 14 are smaller than when the loose-fit countermeasure is adopted.

Therefore, according to the present embodiment, the amount of the viscous material 14 that is consumed to form the seal 104 by filling the continuous clearances 106 with the viscous material 14, that is, the amount of the viscous material 14 that can be wasted by not being used for the intended purpose, is reduced.

5. Improved Operational Efficiency for the Seal

Further, according to the present embodiment, it is possible that the seal 104 is formed by the filling of the viscous material 14 in a shorter length of time than when the loose-fit countermeasure is adopted. In other words, it is possible that the seal 104 is completed more quickly, to thereby improve operational efficiency.

6. Improved Pressure Resistance Performance of the Seal

Further, according to the present embodiment, as described above, the seal 104 is constituted as a rigid-flexible composite structure that is a circumferential array of the continuous clearances 106 that have been filled with the viscous material 14 and the ridges 100 (or any other spacers) formed by a material that is more rigid than the viscous material 14 (e.g., same as the material of the plunger 10 (or the cylinder 18)).

Therefore, according to the present embodiment, the overall rigidity of the seal 104 is higher than when the loose fit countermeasure is adopted. As a result, by way of example, in the discharge phase of the viscous material 14 from the cartridge 12, the possibility that the seal 104 is cracked by the pressurized gas incoming from the pressurizing chamber 74 and the possibility that the seal 104 is locally damaged by the pressurized gas incoming from the pressurizing chamber 74 are eliminated. In other words, the present embodiment improves the capability of the seal 104 to resist a pressure applied against the seal 104.

Therefore, according to the present embodiment, in the discharge phase of the viscous material 14, the possibility that the pressurized gas unintentionally enters the seal 104, thereby passing through the seal 104, and the pressurized gas is introduced into the filling chamber 72 is also eliminated. In other words, the present embodiment makes it easier to more reliably prevent leakage of the pressurized gas in the discharge phase of the viscous material 14.

It is noted that, in the present embodiment, at each slice position of the plunger 10, the circumferential length of each ridge 100 is shorter than that of adjacent ones of the axially-continuous clearances 106, but the invention can be practiced in an alternative arrangement in which the circumferential length of at least one of the ridges 100 is longer than that of adjacent ones of the axially-continuous clearances 106.

In this arrangement, as an example, at least one groove is created on the outer circumferential surface 82 of the plunger 10 extending in a direction including at least an axial component. As a result, in this example, each of the at least one groove(s) defines an axially-continuous clearance 106 in each one of the sliced sections of the plunger 10, while at least one portion of the outer circumferential wall of the plunger 10 (i.e., a portion of the plunger 10 that is conceptually defined as a cylindrical outer shell having a thickness), that is exclusive of the at least one groove, each serves as the spacer. When the invention is implemented, there is no limitation that the width of each spacer is required to be shorter than the width of each axially-continuous clearance 106.

Second Embodiment of the Invention

Next, a cartridge 12 according to an exemplary second embodiment of the present invention will be described. The present embodiment, however, will be described in detail with regard to only the elements that differ from those of the first embodiment, while a redundant description of the elements common with those of the first embodiment will be omitted by citing the common elements using the same names or reference numerals.

Figure 12A:
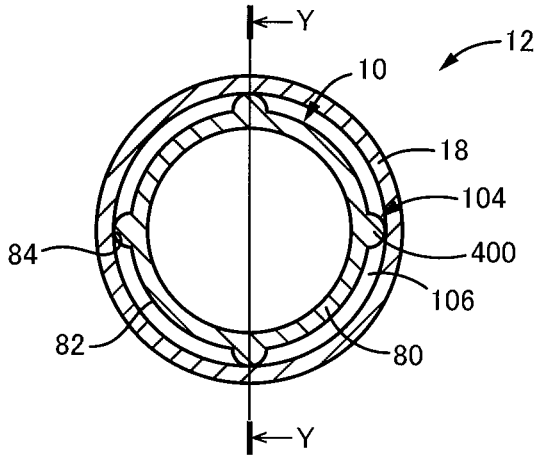
FIG. 12A is a cross-sectional view illustrating a relevant portion of a cartridge according to an exemplary second embodiment of the invention.
Figure 12B:
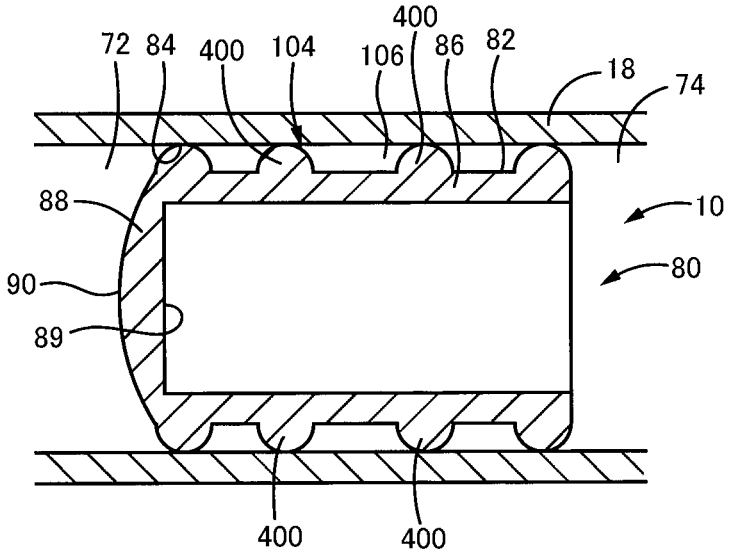
FIG. 12B is a cross-sectional view taken along line Y-Y in FIG. 12A.

FIG. 12A is a cross-sectional view illustrating a relevant portion of the cartridge 12 according to the second embodiment, and FIG. 12B is a cross-sectional view taken along line Y-Y in FIG. 12A.

In the present embodiment, similar to the first embodiment, a plurality of solid elements or spacers are integrally formed with the plunger 10, in the form of a plurality of first members (e.g., a plurality of hemispherical raised portions) 400 that radially outwardly protrude from the outer circumferential surface 82 (the base outer-circumferential-surface) of the plunger 10.

As illustrated in FIG. 12A, the plurality of first members 400 are aligned circumferentially on the outer circumferential surface 82 (the base outer-circumferential-surface) of the plunger 10 such that the first members 400 are spaced apart from each other by a plurality of air gaps, which is to say, a plurality of portions of a single axially-continuous clearance 106.

Further, as illustrated in FIG. 12B, the plurality of first members 400 are aligned axially on the outer circumferential surface 82 (the base outer-circumferential-surface) of the plunger 10 such that the first members 400 are spaced apart from each other by a plurality of interspaces. In the present embodiment, a single unit of the cartridge 12 has a single unit of the axially-continuous clearance 106 formed thereon, and the axially-continuous clearance 106 extends in a direction including not only an axial component but also a circumferential component. The axially-continuous clearance 106 serves as a passageway to allow the filling chamber 72 and the pressurizing chamber 74 to be in fluid communication with each other.

Each first member 400 has a top end face that contacts, at least temporarily (e.g., substantially constantly), the inner circumferential surface 84 of the cylinder 18 and supports the cylinder 18 during operation of the dispenser 20.

Third Embodiment of the Invention

Next, a cartridge 12 according to an exemplary third embodiment of the present invention will be described. The present embodiment, however, will be described in detail with regard to only the elements that differ from those of the first embodiment, while a redundant description of the elements common with those of the first embodiment will be omitted by citing the common elements using the same names or reference numerals.

Figure 13A:
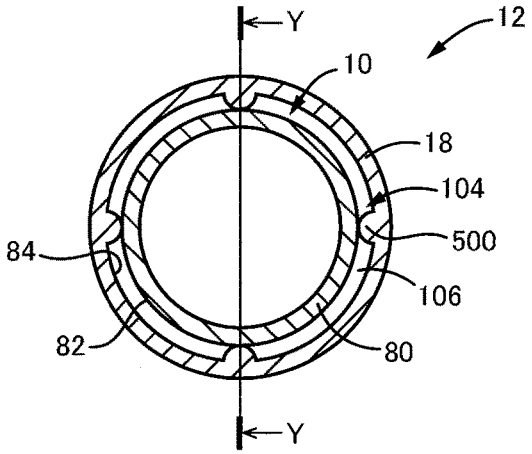
FIG. 13A is a cross-sectional view illustrating a relevant portion of a cartridge according to an exemplary third embodiment of the invention.
Figure 13B:
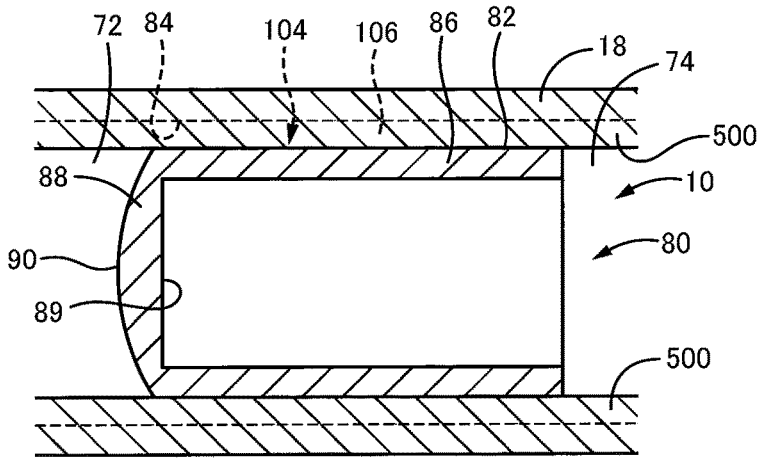
FIG. 13B is a cross-sectional view taken along line Y-Y in FIG. 13A.

FIG. 13A is a cross-sectional view illustrating a relevant portion of the cartridge 12 according to the third embodiment, and FIG. 13B is a cross-sectional view taken along line Y-Y in FIG. 13A.

In the present embodiment, different from the first and second embodiments, a plurality of solid elements or spacers are integrally formed with the cylinder 18, in the form of a plurality of second members (e.g., a plurality of ridges each extending straight in a uniform cross-section) 500 that radially inwardly protrude from the inner circumferential surface 84 (the base inner-circumferential-surface) of the cylinder 18.

As illustrated in FIG. 13A, the plurality of second members 500 are aligned circumferentially on the inner circumferential surface 84 (the base inner-circumferential-surface) of the cylinder 18 such that the second members 500 are spaced apart from each other by a plurality of air gaps, which is to say, a plurality of spaced-apart axially-continuous clearances 106 that are defined by the plurality of second members 500.

Further, as illustrated in FIG. 13B, the plurality of second members 500 each extend axially on the inner circumferential surface 84 (the base inner-circumferential-surface) of the cylinder 18. As a result, in the present embodiment, a single unit of the cartridge 12 has a plurality of circumferentially-aligned axially-continuous clearances 106 formed thereon (adjacent two of the axially-continuous clearances 106 are separated from each other by one of the second members 500 that is interposed between the adjacent two axially-continuous clearances 106), and each axially-continuous clearance 106 extends in a direction including only an axial component. Each axially-continuous clearance 106 serves as a passageway to allow the filling chamber 72 and the pressurizing chamber 74 to be in fluid communication with each other.

Each second member 500 has a top end face that contacts, at least temporarily (e.g., substantially constantly), the outer circumferential surface 82 of the plunger 10 and supports the plunger 10 during operation of the dispenser 20.

It is noted that the second members 500 may be arranged in such a spatially discrete fashion that the second members 500, similar to the first members 400 depicted in FIG. 12, extend not only axially but also circumferentially.

Fourth Embodiment of the Invention

Next, a cartridge 12 according to an exemplary fourth embodiment of the present invention will be described. The present embodiment, however, will be described in detail with regard to only the elements that differ from those of the first embodiment, while a redundant description of the elements common with those of the first embodiment will be omitted by citing the common elements using the same names or reference numerals.

Figure 14A:
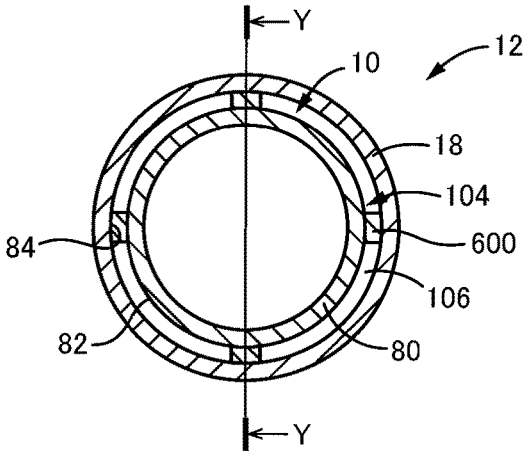
FIG. 14A is a cross-sectional view illustrating a relevant portion of a cartridge according to an exemplary fourth embodiment of the invention.
Figure 14B:
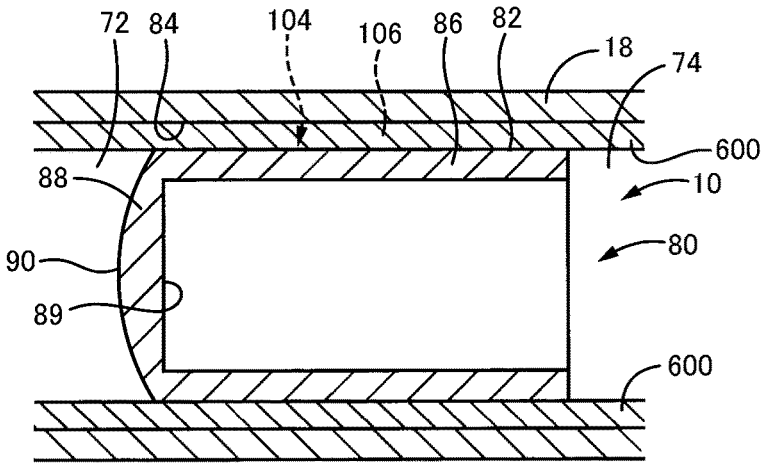
FIG. 14B is a cross-sectional view taken along line Y-Y in FIG. 14A.

FIG. 14A is a cross-sectional view illustrating a relevant portion of the cartridge 12 according to the fourth embodiment, and FIG. 14B is a cross-sectional view taken along line Y-Y in FIG. 14A.

In the present embodiment, different from the first through third embodiments, a plurality of solid elements or spacers are in the form of a plurality of third members 600 that are separate from both the plunger 10 and the cylinder 18 and are configured to be disposed between the outer circumferential surface 82 of the plunger 10 and the inner circumferential surface 84 of the cylinder 18.

As illustrated in FIG. 14A, the plurality of third members 600 are aligned circumferentially between the outer circumferential surface 82 of the plunger 10 and the inner circumferential surface 84 of the cylinder 18 such that the third members 600 are spaced apart from each other by a plurality of air gaps, which is to say, a plurality of spaced-apart axially-continuous clearances 106 that are defined by the plurality of third members 600.

The plurality of third members 600, although not shown, is used in combination with a plurality of circumferentially-extending spacers (i.e., circumferential-spacing defining members) such that one of the spacers is interposed between adjacent two of the third members 600, thereby preventing the adjacent two third-members 600 from approaching each other beyond an approach limit.

Further, as illustrated in FIG. 14B, the plurality of third members 600 each extend axially between the outer circumferential surface 82 of the plunger 10 and the inner circumferential surface 84 of the cylinder 18. As a result, in the present embodiment, a single unit of the cartridge 12 has a plurality of circumferentially-aligned axially-continuous clearances 106 formed thereon (adjacent two of the axially-continuous clearances 106 are separated from each other by one of the third members 500 that is interposed between the adjacent two axially-continuous clearances 106), and each axially-continuous clearance 106 extends in a direction including only an axial component.

The plurality of third members 600 each have an exterior face that contacts, at least temporarily (e.g., substantially constantly), the inner circumferential surface 84 of the cylinder 18 and supports the cylinder 18 during operation of the dispenser 20, and an interior face that contacts, at least temporarily (e.g., substantially constantly), the outer circumferential surface 82 of the plunger 10 and supports the plunger 10 during operation of the dispenser 20.

Fifth Embodiment of the Invention

Next, a cartridge 12 according to an exemplary fifth embodiment of the present invention will be described. The present embodiment, however, will be described in detail with regard to only the elements that differ from those of the first embodiment, while a redundant description of the elements common with those of the first embodiment will be omitted by citing the common elements using the same names or reference numerals.

As illustrated in FIG. 3B, in the first embodiment, in case the inner outline of the shape, which represents the cross section of the inner circumferential surface 84 of the cylinder 18, is a circle, the outer outline of the shape, which represents the cross section of the outer circumferential surface 82 of the plunger 10, is similarly a circle.

Figure 15A:
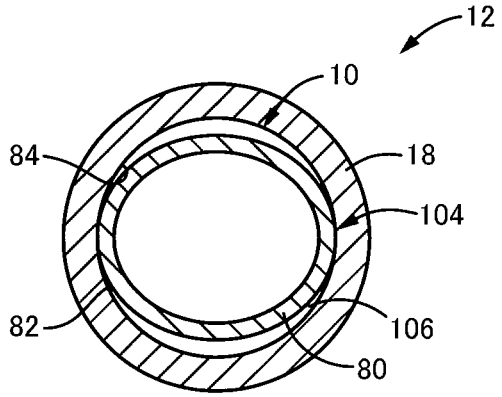
FIG. 15A is a cross-sectional view illustrating a relevant portion of a cartridge according to an exemplary fifth embodiment of the invention.

In contrast thereto, as illustrated in FIG. 15A, in the present embodiment, in case the inner outline of the shape, which represents the cross section of the inner circumferential surface 84 of the cylinder 18, is a circle, the outer outline of the shape, which represents the cross section of the outer circumferential surface 82 of the plunger 10, is an ellipse- or oval-shaped outer circumference (an example of a non-circular endless line).

In the present embodiment, the outer circumferential surface 82 of the plunger 10 is in contact with the inner circumferential surface 84 of the cylinder 18 at two contact points that are diametrically opposed in each cross-sectional slice. As a result, all the cross-sectional slices are uniform in profile, each of which has contact areas where the outer circumferential surface 82 of the plunger 10 contacts the inner circumferential surface 84 of the cylinder 18, and non-contact areas. In this regard, the "contact areas" each constitute an example of a solid element or a spacer as defined above, and the "non-contact areas" each constitute an example of an air gap as defined above.

In the present embodiment, similar to the first embodiment, in the annular region of each cross-sectional slice, contact areas and non-contact areas are alternately circumferential aligned; as a result, the non-contact areas define a plurality of axially-continuous clearances 106 in a spatially discrete fashion between the outer circumferential surface 82 of the plunger 10 and the inner circumferential surface 84 of the cylinder 18. Each axially-continuous clearance 106 functions as a passageway to allow the filling chamber 72 and the pressurizing chamber 74 to be in fluid communication with each other.

In addition, in the present embodiment, the thickness dimensions of the radial clearances between the outer circumferential surface 82 of the plunger 10 and the inner circumferential surface 84 of the cylinder 18 gradually increase as it goes from the contact areas and nears the non-contact areas.

In the present embodiment, boundary areas between the contact areas serving as the spacers and the non-contact areas serving as the axially-continuous clearances 106 are defined by continuous surfaces (e.g., curved surfaces) varying in profile circumferentially and substantially continuously. In case the boundary areas are defined by non-continuous surfaces that are angled, instead of the continuous surfaces, when it is necessary to recycle the cartridge 12 after cleaning a used one, the viscous material 14 can get stuck into sharp-edged depressions on the surfaces of the used cartridge 12, possibly resulting in deterioration in the efficiency of the recycling operation.

In contrast thereto, according to the present embodiment, the boundary areas are defined by continuous surfaces that are not angled, and this allows deposits of the viscous material 14 on the surfaces of the cartridge 12, if any, to be easily wiped out from the surfaces of the cartridge 12, resulting in the recycling operation becoming more efficient.

In order to achieve an object of the invention, it is however not essential to connect the spacers and the axially-continuous clearances 106 with each other circumferentially and substantially continuously.

It is noted that, in the cartridge 12 according to the present embodiment, the outline of the cross section of the outer circumferential surface 82 of the plunger 10 (replaceable with or combinable with the inner circumferential surface 84 of the cylinder 18) may be defined as a curved line obtained by adding two raised portions to a concentric perfect circle, a curved line obtained by adding two recessed portions to the concentric perfect circle, or a curved line obtained by adding two raised portions and two recessed portions to the concentric perfect circle.

In one variant, the outline of the cross section of the outer circumferential surface 82 of the plunger 10 and/or the inner circumferential surface 84 of the cylinder 18 is replaced with an undulating curve (e.g., an undulating spline curve) that is a trace obtained by drawing along a concentric perfect circle while oscillating left-right in a zig-zag manner.

In this variant, three or more raised portions and three or more recessed portions are alternately arrayed, with the raised portions serving as the spacers, respectively, and with a plurality of spaces defined by the recessed portions serving as the plurality of axially-continuous clearances 106, respectively.

In another variant, such undulating curves are created on both the outer circumferential surface 82 of the plunger 10 and the inner circumferential surface 84 of the cylinder 18 such that the curves are complimentary to each other. Further, the outer circumferential surface 82 of the plunger 10 is axially slidably fitted within the inner circumferential surface 84 of the cylinder 18, with some radial clearances left therebetween, in a manner that the raised portions of the outer circumferential surface 82 of the plunger 10 are in the recessed portions of the inner circumferential surface 84 of the cylinder 18, while the recessed portions of the outer circumferential surface 82 of the plunger 10 are in the raised portions of the inner circumferential surface 84 of the cylinder 18.

In this variant, the ones of a plurality of raised portions and a plurality of recessed portions, which are in contact with corresponding mating ones, each serve as the spacer, while the radial clearances serve as the plurality of axially-continuous clearances 106.

In this variant, the outer circumferential surface 82 of the plunger 10 is axially slidably fitted within the inner circumferential surface 84 of the cylinder 18, via raised-and-recessed mating portions disposed entirely or less circumferentially in at least one of the cross sections of the plunger 10 and the cylinder 18.

As a result, during operation of the cartridge 12, the plunger 10 and the cylinder 18 are prevented from unintendedly rotating relative to each other, which stabilizes the dynamic attitude of the plunger 10 within the cylinder 18.

Figure 15B:
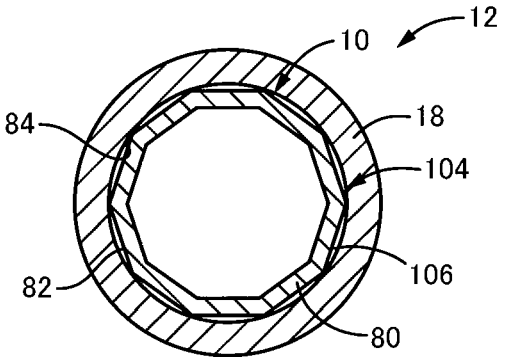
FIG. 15B is a cross-sectional view illustrating a relevant portion of a cartridge according to an exemplary sixth embodiment of the invention.

While, in the variants described above, the raised portions and/or the recessed portions have a curved outline, in still another variant, as illustrated in FIG. 15B, the raised portions and/or the recessed portions have an outline defined as a polygon obtained by interconnecting a plurality of linear segments.

Sixth Embodiment of the Invention

Next, a cartridge 12 according to an exemplary sixth embodiment of the present invention will be described. The present embodiment, however, will be described in detail with regard to only the elements that differ from those of the first embodiment, while a redundant description of the elements common with those of the first embodiment will be omitted by citing the common elements using the same names or reference numerals.

As illustrated in FIG. 3B, in the first embodiment, in case the inner outline of the shape, which represents the cross section of the inner circumferential surface 84 of the cylinder 18, is a circle, the outer outline of the shape, which represents the cross section of the outer circumferential surface 82 of the plunger 10, is similarly a circle.

In contrast thereto, as illustrated in FIG. 15B, in the present embodiment, in case the inner outline of the shape, which represents the cross section of the inner circumferential surface 84 of the cylinder 18, is a circle, the outer outline of the shape, which represents the cross section of the outer circumferential surface 82 of the plunger 10, is a polygon-shaped outer circumference (another example of the non-circular endless line).

In the present embodiment, the outer circumferential surface 82 of the plunger 10 is in contact with the inner circumferential surface 84 of the cylinder 18 at a plurality of contact points that are diametrically opposed in each cross-sectional slice. As a result, all the cross-sectional slices are uniform in profile, each of which has contact areas where the outer circumferential surface 82 of the plunger 10 contacts the inner circumferential surface 84 of the cylinder 18, and non-contact areas. In this regard, the "contact areas" each constitute an example of a solid element or a spacer as defined above, and the "non-contact areas" each constitute an example of an air gap as defined above.

In the present embodiment, similar to the fifth embodiment depicted in FIG. 15A, in the annular region of each cross-sectional slice, contact areas and non-contact areas are alternately circumferentially aligned; as a result, the non-contact areas define a plurality of axially-continuous clearances 106 in a spatially discrete fashion between the outer circumferential surface 82 of the plunger 10 and the inner circumferential surface 84 of the cylinder 18.

In addition, in the present embodiment, the thickness dimensions of the radial clearances between the outer circumferential surface 82 of the plunger 10 and the inner circumferential surface 84 of the cylinder 18 gradually increase as it goes from the contact areas and nears the non-contact areas, similar to the fifth embodiment, except that the fifth embodiment has a gentler slope of the increase in the thickness dimensions than the present embodiment.

It is noted that, in every one of the arrangements described above, as for the mechanical properties of the plunger 10 and the cylinder 18, such as bending elasticity, torsional elasticity, elasticity in a normal direction to the surface, the elasticity of the plunger 10 may be substantially equal to or different from that of the cylinder 18. In the latter case, the elasticity of the plunger 10 may be higher or lower than that of the cylinder 18.

It is further noted that, in every one of the arrangements described above, in the cartridge 12, the viscous material 14 is filled into the filling chamber 72 through the discharge port 67, and during this stroke, the viscous material 14 fills the axially-continuous clearances 106 and forms the seal 104. Thereafter, the viscous material 14 that has filled the filling chamber 72 is discharged through the discharge port 67 by the pressurized gas.

The invention may be practiced in an alternative mode in which, in a stage in which the plunger 10 has not yet been fitted within the cylinder 18, the viscous material 14 is filled through the opening 68 into the filling chamber 72, with the discharge port 67 being plugged, followed by a stroke in which the plunger 10 is being fitted into the cylinder 18, allowing the viscous material 14 that has filled the filling chamber 72 to enter and fill the axially-continuous clearances 106 and form the seal 104.

While every one of the dispensers 20 loaded into the cartridges 12 according to the embodiments described above of a pneumatic dispenser that discharges a viscous material by pressurizing a plunger 10 using pressurized gas, the dispensers 20 may be replaced with other types of dispensers. For example, such other types of dispensers may include a mechanically-driven dispenser that discharges a viscous material by pressing a plunger 10 using a mechanical force, and an electrically-driven dispenser that discharges a viscous material by pressing a plunger 10 using an electric motor.

The present specification provides a complete description of the compositions of matter, methodologies, systems and/or structures and uses in exemplary implementations of the presently-described technology. Although various implementations of this technology have been described above with a certain degree of particularity, or with reference to one or more individual implementations, those skilled in the art could make numerous alterations to the disclosed implementations without departing from the spirit or scope of the technology thereof. Furthermore, it should be understood that any operations may be performed in any order, unless explicitly claimed otherwise or a specific order is inherently necessitated by the claim language. It is intended that all matter contained in the above description and shown in the accompanying drawings shall be interpreted as illustrative only of particular implementations and are not limiting to the embodiments shown. Changes in detail or structure may be made without departing from the basic elements of the present technology as defined in the following claims.

The invention claimed is:

1. A cartridge for a viscous-material dispenser configured to discharge a viscous material, comprising:

a cylinder having a first end and a second end and a discharge port disposed at the first end to discharge the viscous material from the cylinder;

a plunger axially slidably fitted within the cylinder and dividing the cylinder into an anterior chamber between the first end of the cylinder and the plunger and a posterior chamber between the second end of the cylinder and the plunger, the anterior chamber serving as a filling chamber into which the viscous material is fillable from outside the cylinder through the discharge port; and a seal between an inner circumferential surface of the cylinder and an outer circumferential surface of the plunger, wherein the seal comprises:

a plurality of solid spacers in an annular gap between the outer circumferential surface of the plunger and the inner circumferential surface of the cylinder, the plurality of solid spacers defining a radial distance between the outer circumferential surface of the plunger and the inner circumferential surface of the cylinder a plurality of axially-continuous clearances between the plunger and the cylinder formed such that the axially-continuous clearances are circumferentially spaced apart from each other by the plurality of spacers, each axially-continuous clearance extending in a direction having an axial directional component and fluidically connecting the anterior chamber and the posterior chamber, and a body of the viscous material extending from the filling chamber into the plurality of axially-continuous clearances such that the plurality of filled axially-continuous clearances and the plurality of spacers together form the seal, and wherein the plurality of solid spacers is integrally formed with the plunger and protrude radially outwardly from the outer circumferential surface of the plunger, and the solid spacers have a top end face configured to contact the inner circumferential surface of the cylinder to support the cylinder during an operation of the cartridge, thereby allowing the plunger to be snug-fitted with the cylinder only at the solid spacers, thereby allowing the solid spacers to circumferentially separate the axially-continuous clearances from each other.

2. A cartridge for a viscous-material dispenser configured to discharge a viscous material, comprising:

a cylinder having a first end and a second end;

a plunger axially slidably fitted within the cylinder and dividing the cylinder into an anterior chamber between the first end of the cylinder and the plunger and a posterior chamber between the second end of the cylinder and the plunger, the anterior chamber serving as a filling chamber into which the viscous material is fillable from outside the cylinder; and a seal between an inner circumferential surface of the cylinder and an outer circumferential surface of the plunger, wherein the seal comprises:

a plurality of solid spacers in an annular gap between the outer circumferential surface of the plunger and the inner circumferential surface of the cylinder, the plurality of solid spacers defining a radial distance between the outer circumferential surface of the plunger and the inner circumferential surface of the cylinder;

a plurality of axially-continuous clearances between the plunger and the cylinder formed such that the axially-continuous clearances are circumferentially spaced apart from each other by the plurality of spacers, each axially-continuous clearance extending in a direction having an axial directional component and fluidically connecting the anterior chamber and the posterior chamber; and a body of the viscous material extending from the filling chamber into the plurality of axially-continuous clearances such that the plurality of filled axially-continuous clearances and the plurality of spacers together form the seal, wherein the plurality of solid spacers is integrally formed with the cylinder and protrude radially inwardly from the inner circumferential surface of the cylinder.

3. The cartridge according to claim 2, wherein the solid spacers have a top end face configured to contact the outer circumferential surface of the plunger to support the plunger during operation of the cartridge.

4. A cartridge for a viscous-material dispenser configured to discharge a viscous material, comprising:

a cylinder having a first end and a second end;

a plunger axially slidably fitted within the cylinder and dividing the cylinder into an anterior chamber between the first end of the cylinder and the plunger and a posterior chamber between the second end of the cylinder and the plunger, the anterior chamber serving as a filling chamber into which the viscous material is fillable from outside the cylinder; and a seal between an inner circumferential surface of the cylinder and an outer circumferential surface of the plunger, wherein the seal comprises:

a plurality of solid spacers in an annular gap between the outer circumferential surface of the plunger and the inner circumferential surface of the cylinder, the plurality of solid spacers defining a radial distance between the outer circumferential surface of the plunger and the inner circumferential surface of the cylinder;

a plurality of axially-continuous clearances between the plunger and the cylinder formed such that the axially-continuous clearances are circumferentially spaced apart from each other by the plurality of spacers, each axially-continuous clearance extending in a direction having an axial directional component and fluidically connecting the anterior chamber and the posterior chamber; and a body of the viscous material extending from the filling chamber into the plurality of axially-continuous clearances such that the plurality of filled axially-continuous clearances and the plurality of spacers together form the seal, wherein the plurality of solid spacers are not integrally formed with the plunger and are not integrally formed with the cylinder and are disposed between the outer circumferential surface of the plunger and the inner circumferential surface of the cylinder.

5. The cartridge according to claim 4, wherein the solid spacers include an exterior face configured to contact the inner circumferential surface of the cylinder to support the cylinder during an operation of the cartridge, thereby allowing the plunger to be snug-fitted or loose-fitted with the cylinder, and an interior face configured to contact the outer circumferential surface of the plunger to support the plunger during the operation of the cartridge, thereby allowing the plunger to be snug-fitted or loose-fitted with the cylinder.

6. The cartridge according to claim 1, wherein the dispenser is a pneumatic dispenser configured to discharge the viscous material from the first end of the cylinder by applying a pressurized gas against the plunger from the posterior chamber, and the posterior chamber serves a pressurizing chamber into which the pressurized gas is introduced from the outside.

7. The cartridge according to claim 1, wherein the cartridge is a dispensing cartridge for dispensing the viscous material.

8. The cartridge according to claim 1, wherein the plurality of axially continuous clearances comprise a plurality of axially continuous passages each having a first end at the anterior chamber and a second end at the posterior chamber.

9. The cartridge according to claim 8, wherein the plurality of axially continuous passages are each bounded by first and second continuous side walls.

* * * * *